US007665602B2

(12) United States Patent
Palamara et al.

(10) Patent No.: US 7,665,602 B2
(45) Date of Patent: Feb. 23, 2010

(54) READY-MADE DISH DISPOSABLE PACKAGING, EQUIPPED OF VENT DEVICE FOR INNER VAPORS

(76) Inventors: Antonio Palamara, Via Figurella 2A, Catona (IT) I-89053; Mariantonia Cotronei, Via Bellacasa 1, Salice Calabro (IT) I-89053

( * ) Notice: Subject to any disclaimer, the term of this patent is extended or adjusted under 35 U.S.C. 154(b) by 505 days.

(21) Appl. No.: 11/570,524

(22) PCT Filed: Jun. 28, 2005

(86) PCT No.: PCT/IT2005/000371

§ 371 (c)(1),
(2), (4) Date: Dec. 13, 2006

(87) PCT Pub. No.: WO2006/001048

PCT Pub. Date: Jan. 5, 2006

(65) Prior Publication Data

US 2007/0181450 A1 Aug. 9, 2007

(30) Foreign Application Priority Data

Jun. 28, 2004 (IT) ..... CS2004A0006
Jun. 27, 2005 (IT) ..... CZ2005A0011

(51) Int. Cl.
*B65D 77/00* (2006.01)

(52) U.S. Cl. ..... 206/216; 206/219; 220/89.1; 220/506; 220/573.1

(58) Field of Classification Search ..... 220/89.1, 220/367.1, 501, 506, 523, 524, 526, 573.1; 206/216, 219; 426/112, 115, 120
See application file for complete search history.

(56) References Cited

U.S. PATENT DOCUMENTS

| | | | | |
|---|---|---|---|---|
| 2,633,284 | A | 3/1953 | Moffett et al. | |
| 6,789,690 | B2 * | 9/2004 | Nieh et al. | 220/231 |
| 7,163,102 | B2 * | 1/2007 | Palamara et al. | 206/219 |
| 2004/0188442 | A1 * | 9/2004 | Ohyama | 220/367.1 |
| 2008/0283424 | A1 * | 11/2008 | Palamara et al. | 206/219 |

FOREIGN PATENT DOCUMENTS

| | | | |
|---|---|---|---|
| WO | 03/006323 | A | 1/2003 |
| WO | 2004/045985 | A | 6/2004 |

* cited by examiner

*Primary Examiner*—Anthony Stashick
*Assistant Examiner*—Madison L Wright
(74) *Attorney, Agent, or Firm*—David A. Guerra

(57) ABSTRACT

Ready made dish disposable packaging comprising a container (1) which defines a first compartment (2) and at least one second compartment (3). The container (1) can have a bowl form and is closed in its upper part by a superior sealing film (21) which is also an integral and substantial part of a vent device of inner vapors. The second compartment (3) is, on the contrary, closed by means of a sliding sealing system comprising a plug (14), In the closure position of the plug (14), it is impossible that the component contained in the second compartment (3) enters in contact with the component contained in the first compartment (2), while in the opening position of the plug (14), the component contained in the second compartment (3) can spill out through the lateral openings of the plug (14).

20 Claims, 21 Drawing Sheets

Fig.

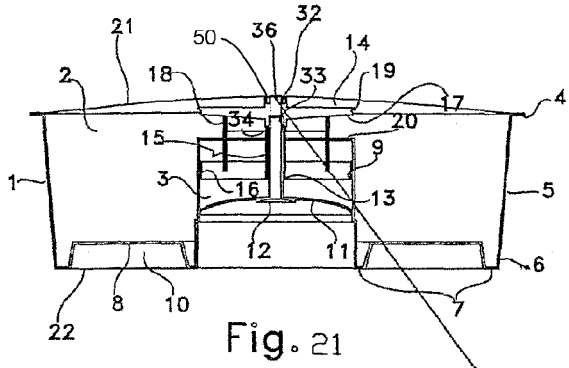
Fig. 21
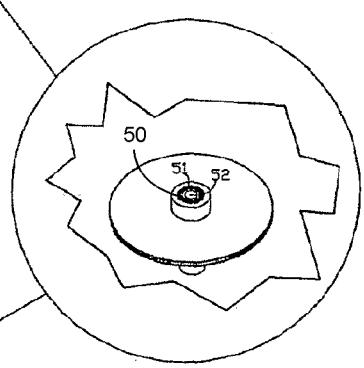
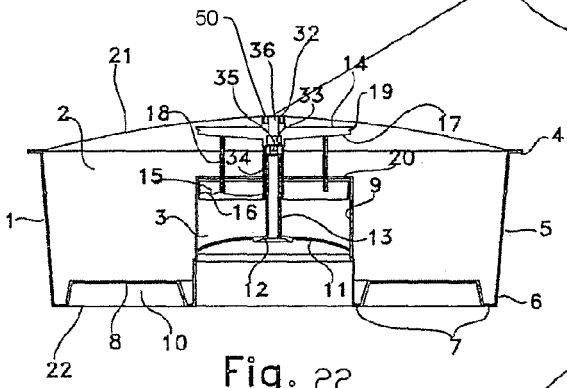
Fig. 22
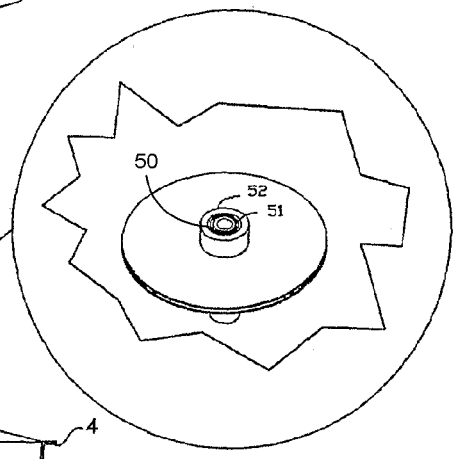
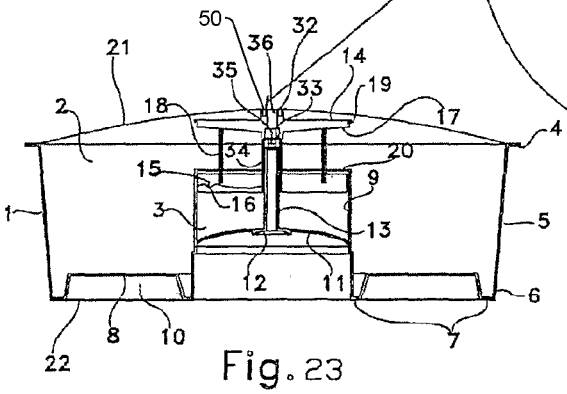
Fig. 23

READY-MADE DISH DISPOSABLE PACKAGING, EQUIPPED OF VENT DEVICE FOR INNER VAPORS

CROSS-REFERENCE TO RELATED APPLICATIONS

This application is an U.S. national phase application under 35 U.S.C. §371 based upon co-pending International Application No. PCT/IT2005/000371 filed on Jun. 28, 2005. Additionally, this U.S. national phase application claims the benefit of priority of co-pending International Application No. PCT/IT2005/000371 filed on Jun. 28, 2005; Italy Application No. CS2004A000006 filed on Jun. 28, 2004; and Italy Application No. CZ2005A000011 filed on Jun. 27, 2005. The entire disclosures of the prior applications are incorporated herein by reference. The international application was published on Jan. 5, 2006 under Publication No. WO 2006/001048.

TECHNICAL FIELD

The present invention regards the field of packagings destinated to contain products ready to use, also by heating or baking, constituted by two or more than two components to be put in contact before the usage and, in particular, field of packagings destinated to contain food products with said characteristics.

For example, the invention can be used for mixing vegetables and relative seasonings, noodles and sauces, scrambled eggs and bread-crumbs (for omelette cooking), ecc.

So, the invention is useful not only for the final user (consumer), but can be used also in restaurants or house kitchens, in order to make cooking more rapid and easy before their further treatment (for example, baking in a traditional or microwave oven).

STATE OF THE ART

Nowadays, different types of packagings for products ready to use, also by baking or heating, both in domestic or extra-domestic environment, are known.

As far as, in particular, the food products are concerned, these types of packagings are:

- packagings comprising a rigid container of plastic material, open in the upper part, similar to a soup-plate of various form (circular, oval, ecc.), containing all the food ingredients already mixed, closed by a film of plastic material and provided or not with vent devices. The particular disadvantage of these packagings is constituted by the fact that as the ingredients are mixed before, the solid components (noodle, rice, ecc.) tend to absorb these liquids to detriment of consistency, taste and presentation of meal;
- packagings comprising more than two containers of plastic material, each of which contains a food component to be mixed before the usage, in which at least one container is rigid and has also a reception function for the mixing and the thermal treatment in a completely open packaging mode. In this case, the user, after having removed the sealing film of said receiver, opens one or more than two bags or rigid containers at its disposal and pours the content on the remaining part of the food to complete the heating or baking preparation. The particular disadvantage of these packagings for foods is that it is very easy to shed the bags or rigid containers content on the clothes or other objects making this operation not very practical and not very hygienic. Besides, as said remaining part of the food normally occupies (by reasons of space optimization) the whole volume of its container (that acts as a mixing receiver), the mixing operation of various food components results difficult, if not impossible, where it is desired to evict the spill of the food out of the packaging.

Besides, being the packaging completely open, the heating time will be relatively longer and the product will result drier, dissolving many inner humidity and producing a complexely worse result;

- packagings of vegetables containing a bag of aqueous solution which under the heat action releases vapour for the heating. The particular disadvantage of these packagings consists in the fact that they permit to realise only this application.

In no case mentioned above it is possible to mix different food components in a closed packaging or by means of thermical treatment. Still, the general disadvantage of all the packagings mentioned above is that eventual vent devices, they are provided with, when activated, provoke a "permanent opening" of the packaging (more or less extended breakthrough or hole of the superior sealing film or of some other part, on which said devices are eventually applied). Said opening, which, like in case of containers not provided with said devices and which, hence, must be opened or holed by hand before heating or baking, determines:

- the impossibility to mix the food pre- or post-heating or baking by "shakering" of the completely closed packaging;
- the continuous spill out of vapours produced inside the packaging to detriment of time and efficiency of product heating or baking.

To be complete, it is necessary to add to the packaging types mentioned above, the one disclosed in the international patent application WO 03/006323, filed by the present invention authors, describing a packaging which not being provided with particular vent systems presents the disadvantages indicated in the last two points mentioned above.

The prevailing baking mode for all the packaging types mentioned above is that of microwave oven, but there can also be the packagings made of a material which can be used in traditional oven.

The aim of the present invention is, hence, that to put at a disposal a packaging for product ready to use, also upon heating or baking, which permits:

- to keep separately the components of the product up to the moment of usage;
- to mix different components of the product in an efficient and/or hygienic mode when necessary, both before and after the eventual thermical treatment, in base of necessities and type of the product;
- to act a "calibrated" vent of the internal vapours, also to realize more rapid and efficient baking or heating.

BRIEF DESCRIPTION OF THE FIGURES

The present invention and its particular advantages will be described in an illustrative and not limiting way, making reference to some preferred realizations on the following figures:

FIG. 8 (II) prospect\vertical section A-A' of the plug with stem valve;

FIG. 9 (II) vertical section A-A' of the stem valve;

FIG. 9 (III) transversal section B-B' of the stem valve;

FIG. 18 (II) prospect\vertical section A-A' of the plug;

FIG. 21 vertical section of the container with plug in closed position with closed seal;

FIG. 22 vertical section of the container with plug in closed position in pression with closed seal;

FIG. 23 vertical section of the container with plug in closed position in pression with open seal.

DETAILED DESCRIPTION OF THE FIGURES

Figure 1:
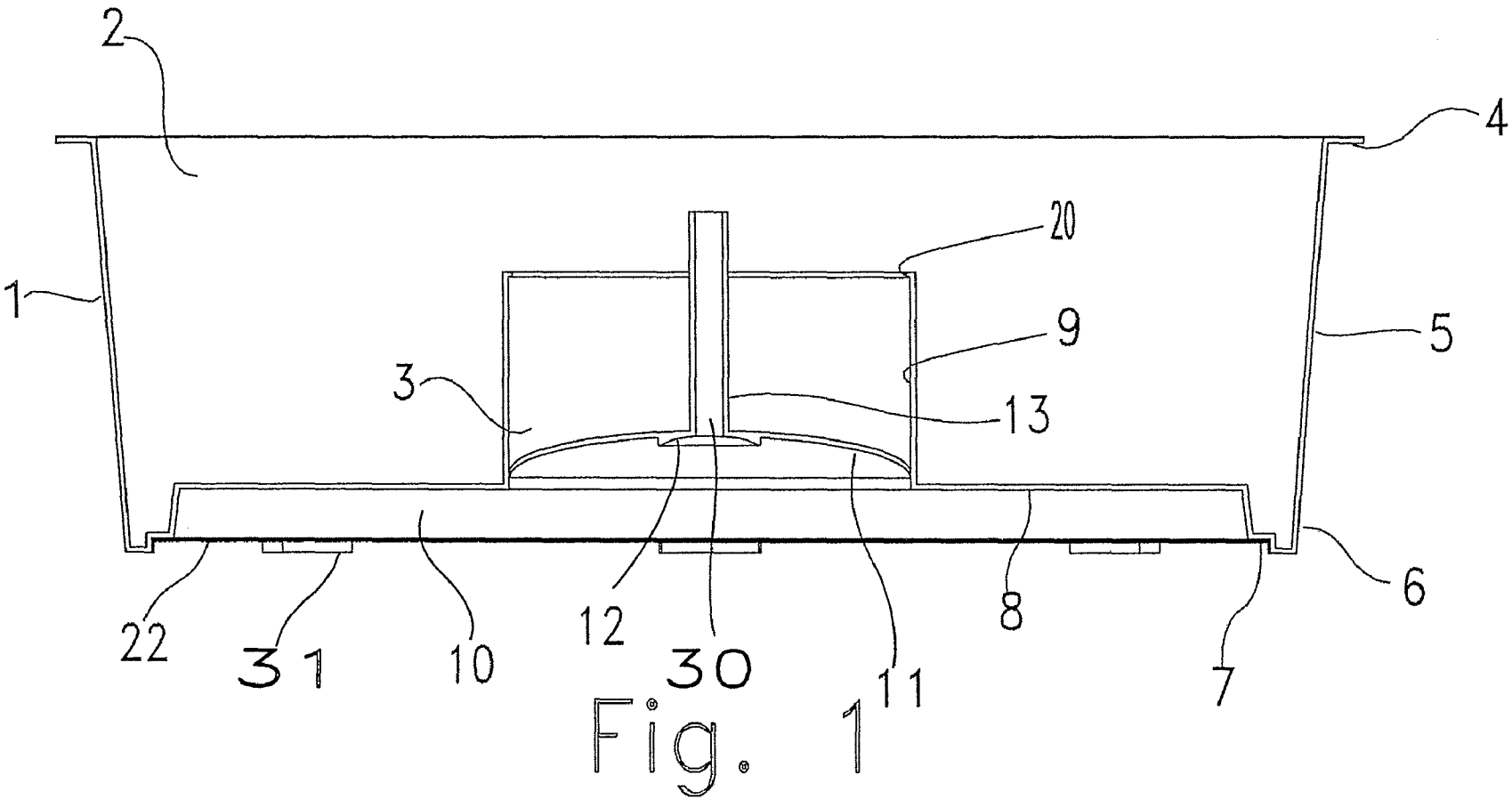
FIG. 1 vertical section of the container with applied inferior sealing film.

Referring to FIG. 1, the container (1), constituted by an external lateral wall (5), which ends with a superior flange (4), and by a base surface (8), forms a first compartment (2), internally limited by the wall (9) superiorly provided with perimetrical rib (20), in the figure represented as a semicircular section.

To said wall (9) a mobile base (11) is jointed, to form at least a second compartment (3). The mobile base (11) is provided in its centre with a vertical sliding guide (13), grooved in the variant here represented, in which correspondence a hollow on the inferior face (12) is present.

The base surface (8) presents on its end a nib (6), on which both the spread pins (31), able to create, in phase of the product usage, a passage between the packaging bottom and external environment, which function will be explained further, and a plain surface (7) are drawed. Such bottom conformation forms a correspondent reentrant (10), able to contain additionals, not shown here, as represented in a simplificated manner on FIG. 10, kept by an inferior sealing film (22), applied to the plain surface (7) by any known process.

Figure 2:
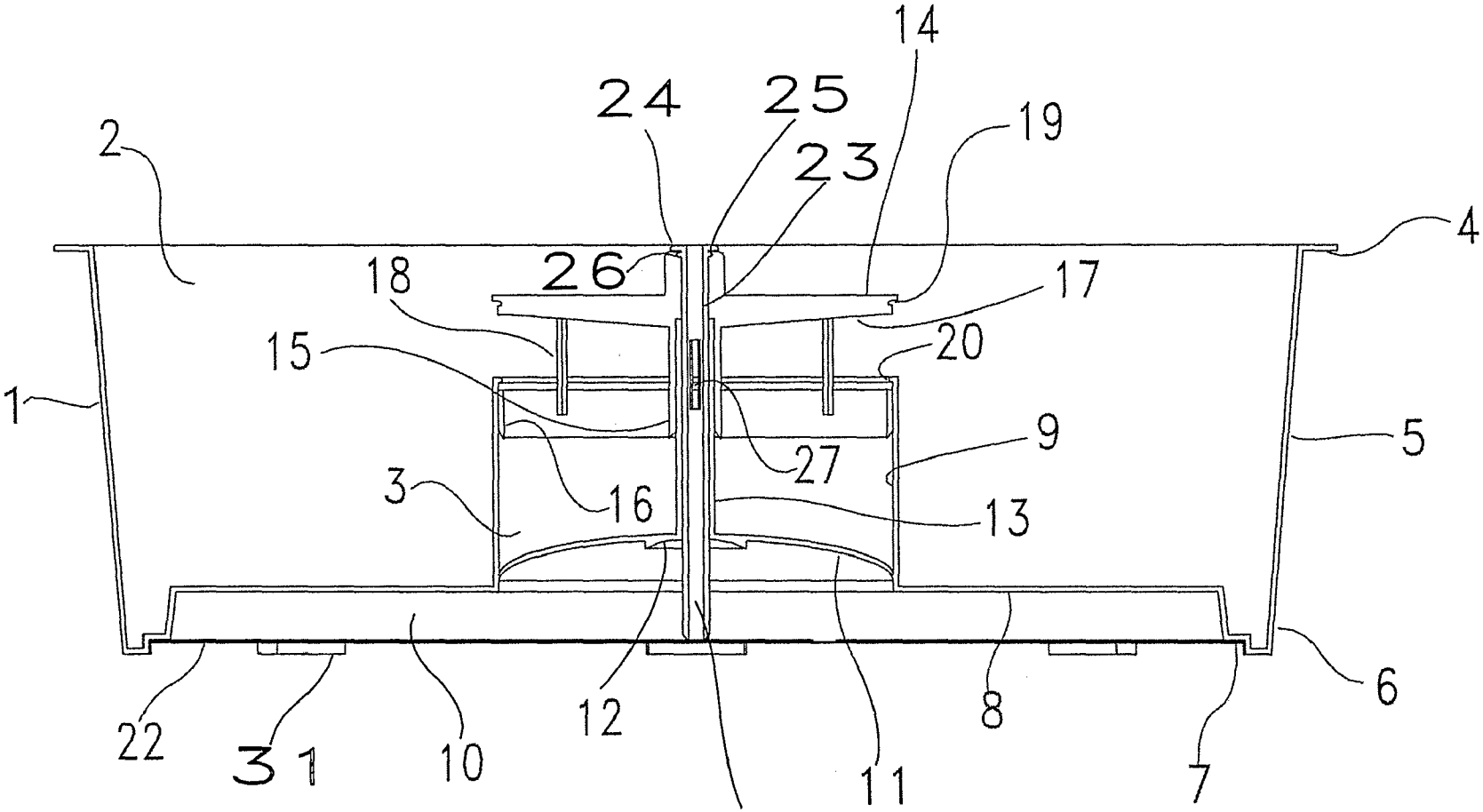
FIG. 2 vertical section of the container after the insertion of the plug coupled to the stem valve, upon filling of the second compartment 3.

Referring to FIG. 2, in the second compartment (3), upon its filling with a specific product component, the plug (14) is inserted.

Said plug (14) is constituted by a coupling and sliding element (16) inside the wall (9) and by an element (17), jointed to the coupling and sliding element (16) by means of linking bars (18), being said element (17) both internally inclined in order to favour the runoff towards the first compartment (2) of the component placed inside the second compartment (3) and provided in the centre of the lower part with a coupling protuberance (15) which couples with the guide (13).

The plug (14) presents, besides, a perimetrical groove (19), with semicircular section in the figure, which is complementary to the perimetrical rib (20), with semicircular section in the figure which the wall (9) ends with.

In said plug (14) a stem valve (23) is inserted, which defines a vent channel (30), having a function which will be explained further.

Said stem valve (23) is provided, in the upper part, with a surface (24) and with a perimetrical rib (26), with semicircular section in the figure, complementary to the perimetrical groove (25), with semicircular section in the figure, present on the superior part of the plug (14), and is provided with openings (27) to put into communication the vent channel (30) with the external environment.

Figure 3:
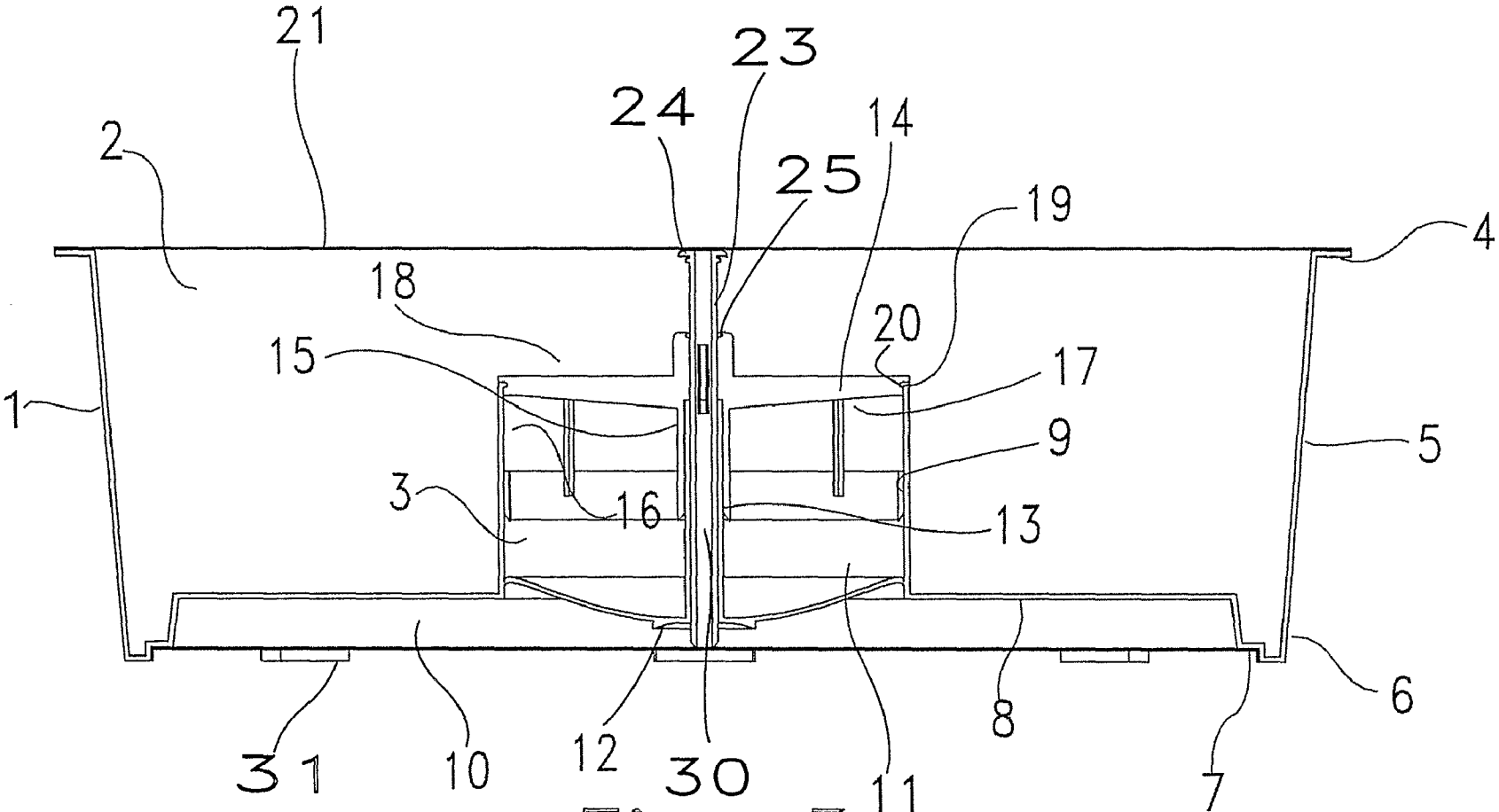
FIG. 3 vertical section of the container after the plug closure and the application of superior sealing film, upon filling of the first compartment 2.

Referring to FIG. 3, the plug (14) runs up to close the second compartment (3), adhering with the perimetrical groove (19) to the complementary perimetrical rib (20) of the wall (9).

During such operation the plug (14), by the strike effect between the coupled sliding guide (13) and coupling protuberance (15), moves down the mobile base (11), which deforms elastically in order to perform a function which will be explained further and holds it in this position from the moment of closure with the same plug (14).

Realizing so, the separation between the compartments, the first compartment (2) can, hence, be filled in such a way that different components contact between each other, only in the moment of usage of the product.

So, the packaging is closed in the upper part by means of the superior sealing film (21), adhered both to the flange (4) of the container, and to the surface (24) of the stem valve (23), preferably by thermowelding or some known process, which permits anyway to maintain the perfect adherence of the superior sealing film (21) both with the flange (4) and with the surface (24), also in the conditions of thermal variations during the heating or baking by means of the present invention.

For using of the product in this configuration it is necessary, first to remove the inferior sealing film (22), in order to put in communication the vent channel (30) with the external environment and remove the additionals (FIG. 10) not shown up to here.

Figure 4:
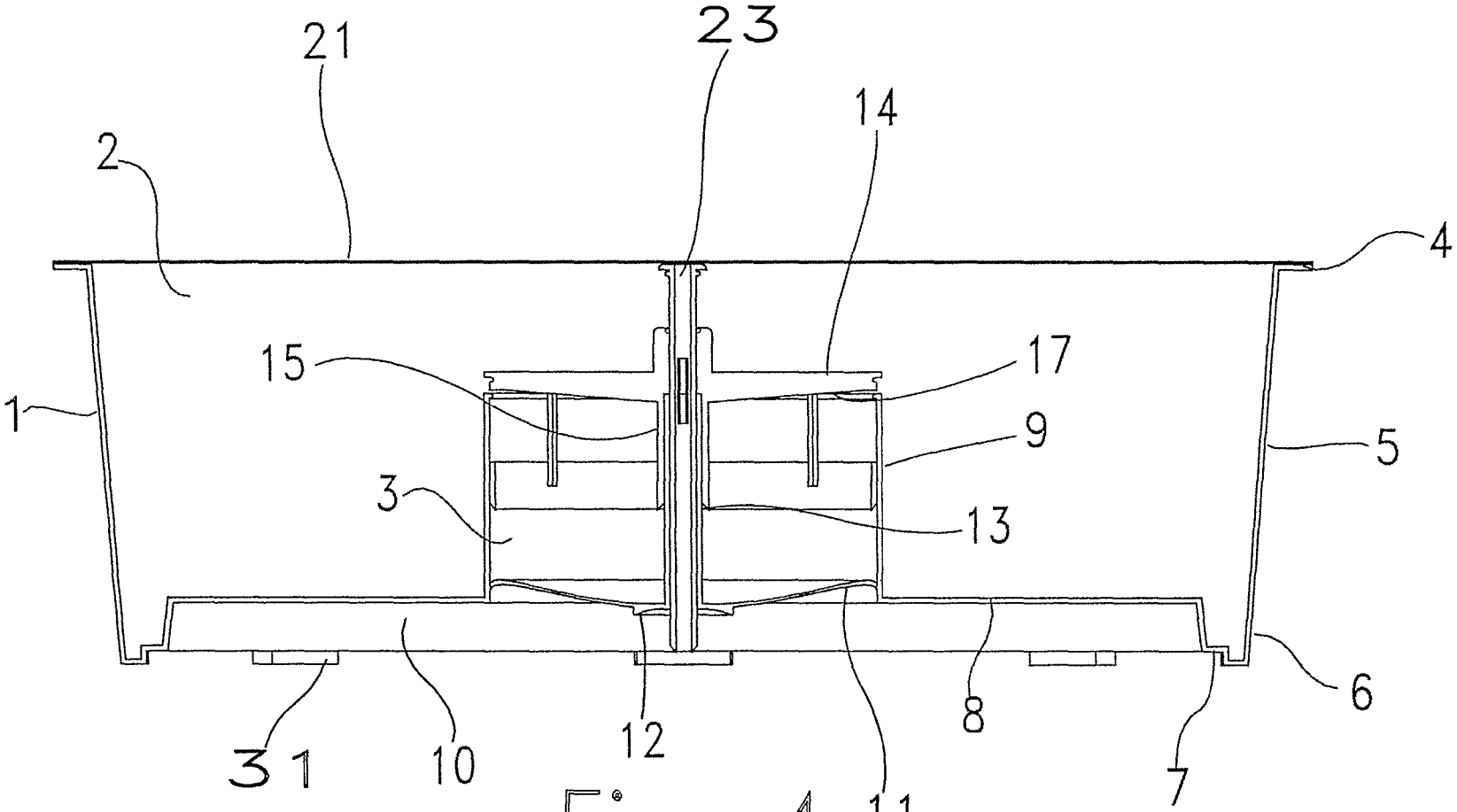
FIG. 4 vertical section of the container after the plug ejection from its closure position.

Referring to FIG. 4, the user, in base of the product requirements, either pushes onto the bottom, in correspondence of the hollow (12) of the mobile base (11), in order to execute by hand the plug (14) opening, eventually mixes also the two components of the product shaking the packaging and, finally, introduces it into an oven, for example microwave, or passes directly to this latter operation.

In the second case, when the preventive opening of the closure measures of the compartment (3) is not expected, a certain enhancing of the internal pressure of said compartment, which could occur, for example, during the baking or heating of the product makes the plug (14) spill out from its closure position.

The spill out of the plug (14) from its said closure position removes the barrier maintained by the mobile base (11) deformed elastically as indicated in FIG. 3. Consequently, said base returns to its original conformation, as shown in FIG. 2, pushing up the plug (14) up to the stop position corresponding to the complete opening of the same, as it is better shown in the next FIG. 5.

Figure 5:
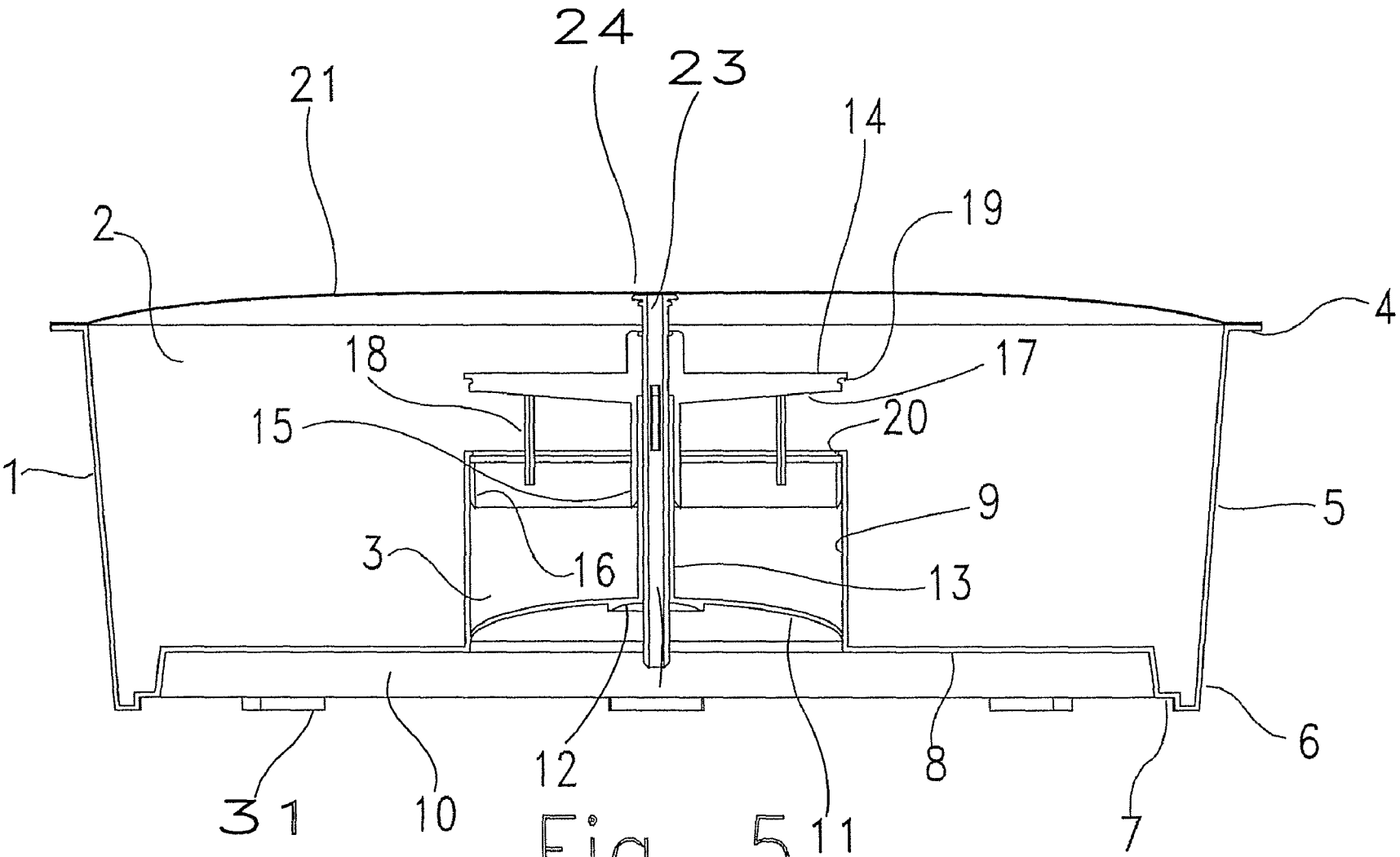
FIG. 5 vertical section of the container with the completely open plug.

Referring to FIG. 5, once the communication between different compartments is realized, the enhancement of the internal pressure of the container is compensated by the reinflating of the superior sealing film (21).

Thanks to the barrier between the superior sealing film (21) and the surface (24), said superior sealing film (21) moves with itself the stem valve (23) in a vertical sliding movement.

Figure 6:
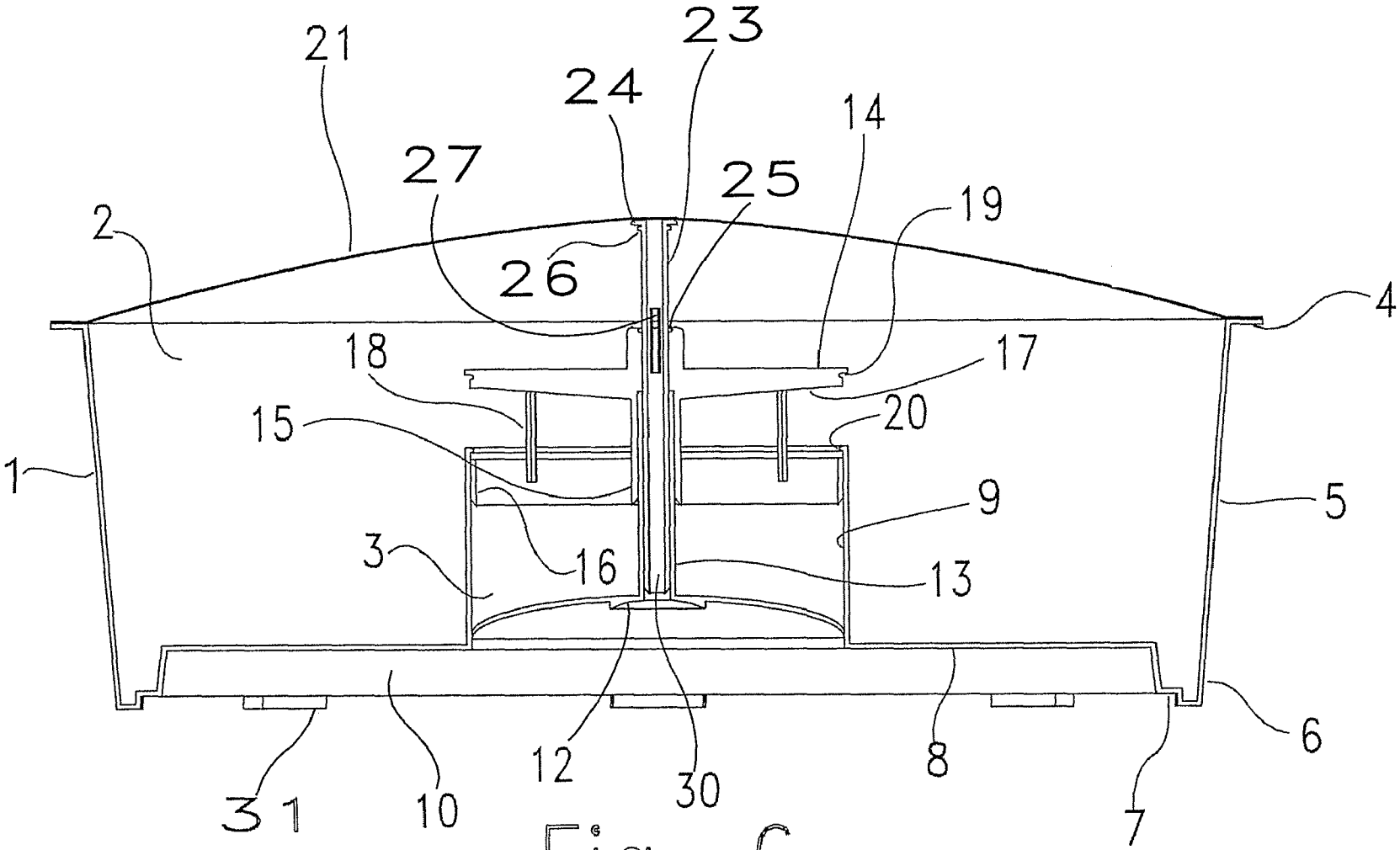
FIG. 6 vertical section of the container with activated vent devices.

Referring to FIG. 6, a further enhancement of internal pressure of the container (1) is compensated by a major reinflating of the superior sealing film (21), until the openings (27), rising over the superior protuberance of the plug (14), through the vent channel (30) and the spaces present between the spread pins (31) put into communication the container (1) with the external environment. In such a way it is possible both to control the internal pressure of the packaging, reducing it suitably in order to avoid any explosion danger, and to maintain optimal conditions for rapid and efficient heating or baking.

Figure 7:
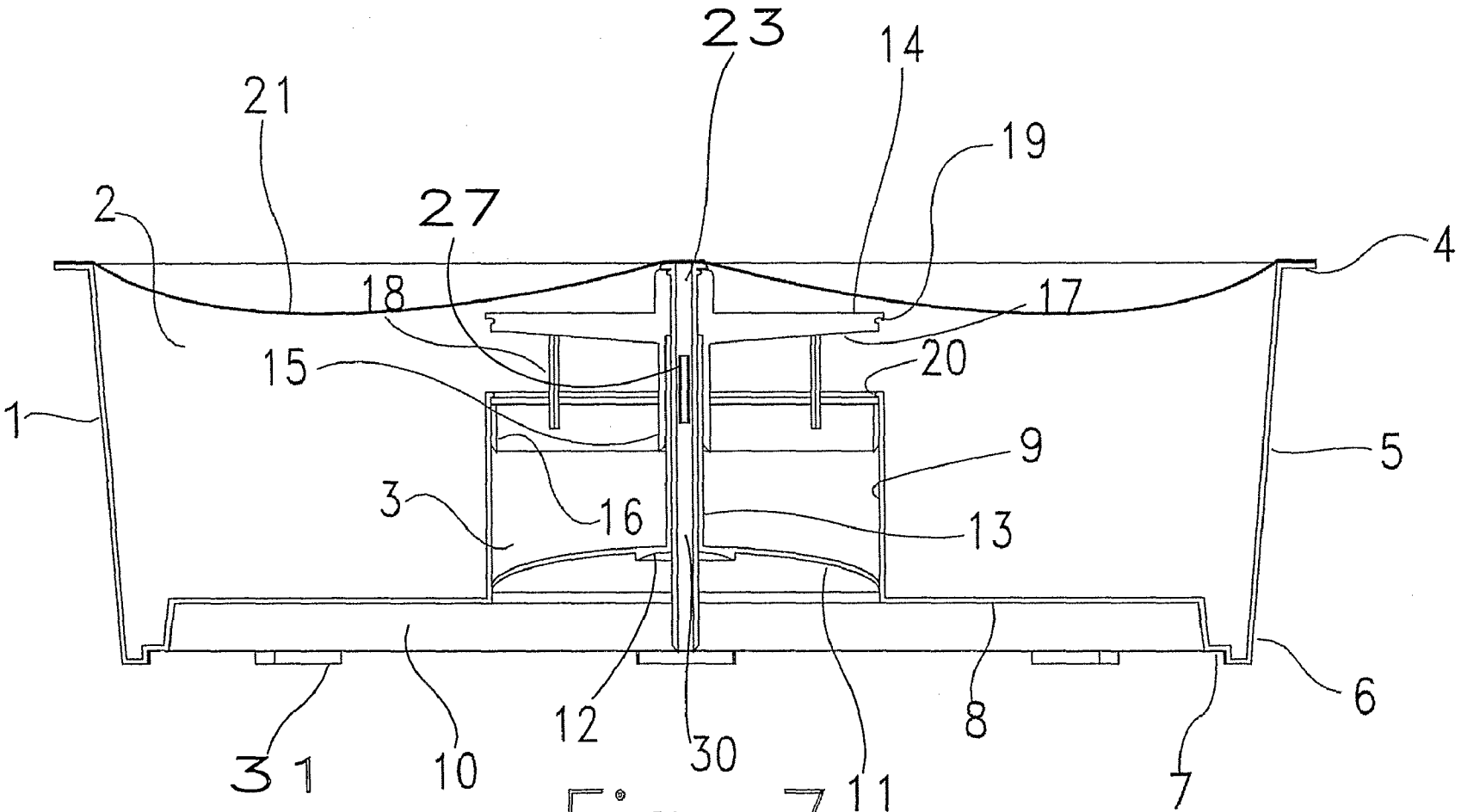
FIG. 7 vertical section of the container with closed vent devices.

Referring to FIG. 7, (for example, following the temperature reduction after the temporary or definite suspension of heat or microwaves erogation from the heating or baking instrument), it is observed the reentering towards the internal part of the container (1), of the superior sealing film (21), which moves down the stem valve (23), up to closing the passage with the external environment realized by the openings (27). Everything described in reference to FIGS. 5-7 can repeat in a cycle up to the end of heating or baking.

Figure 8:
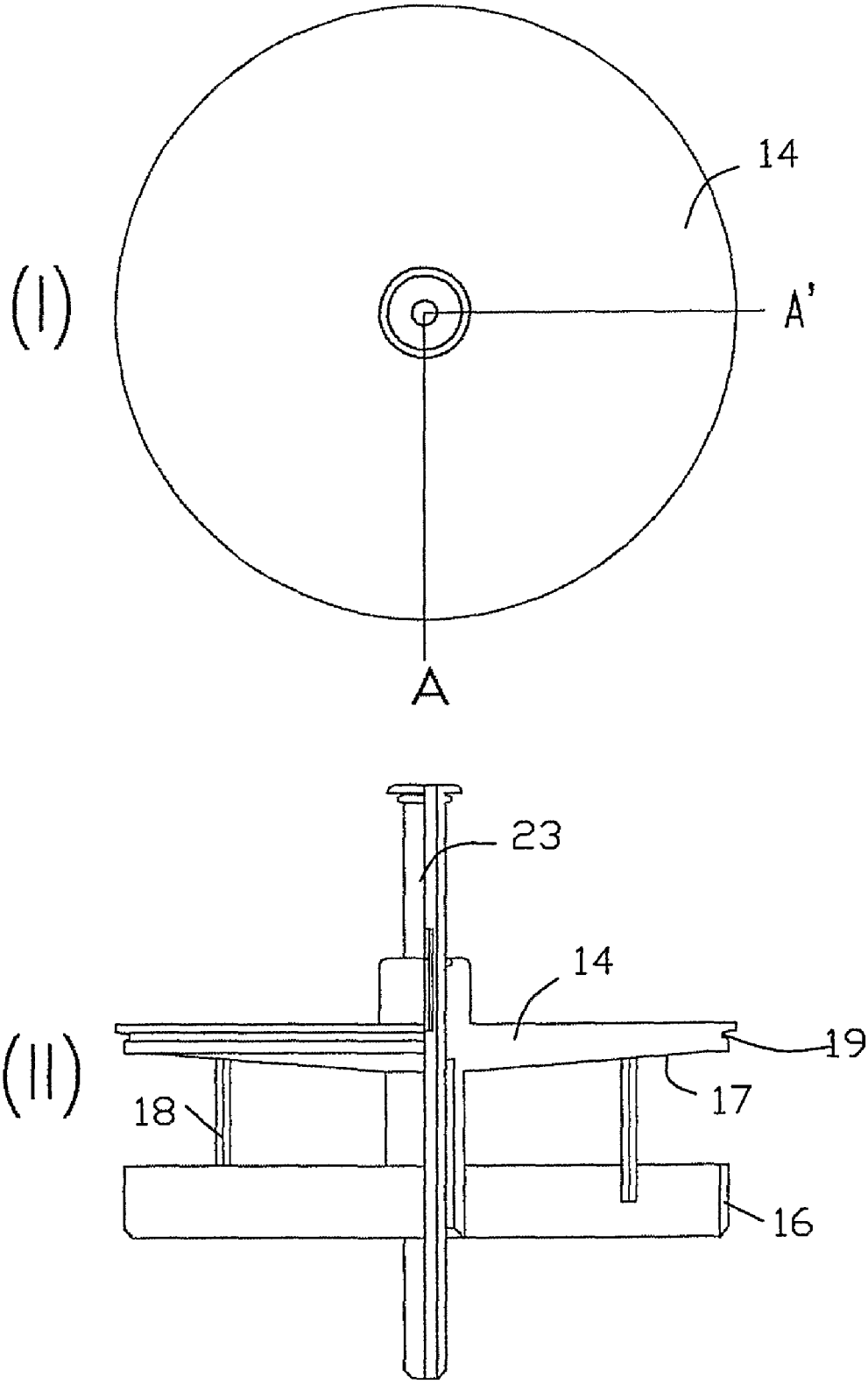
FIG. 8 (I) upper view of the plug with the stem valve.

Referring to FIG. 8, in the representation (I), the upper view of the plug (14) with the stem valve inserted in it is shown, while in the representation (II) a longitudinal section A-A' and a partial prospect of said plug (14) and stem valve (23) are shown.

Figure 9:
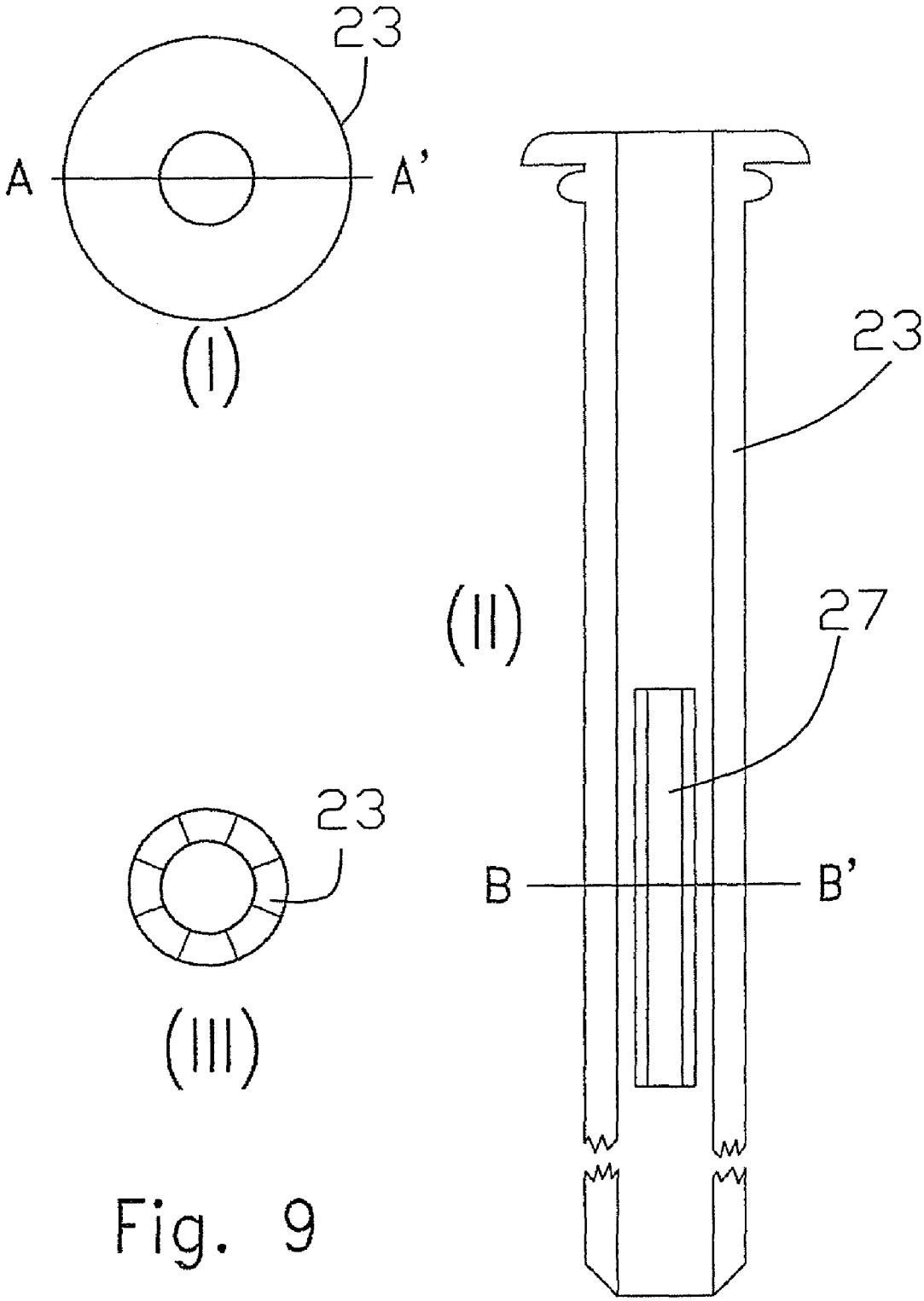
FIG. 9 (I) upper view of the stem valve.

Referring to FIG. 9, in the representation (I) the upper view of the stem valve (23) is shown, in the representation (II) its longitudinal section A-A' is shown and in the representation (III) its transversal section B-B' is shown.

Figure 10:
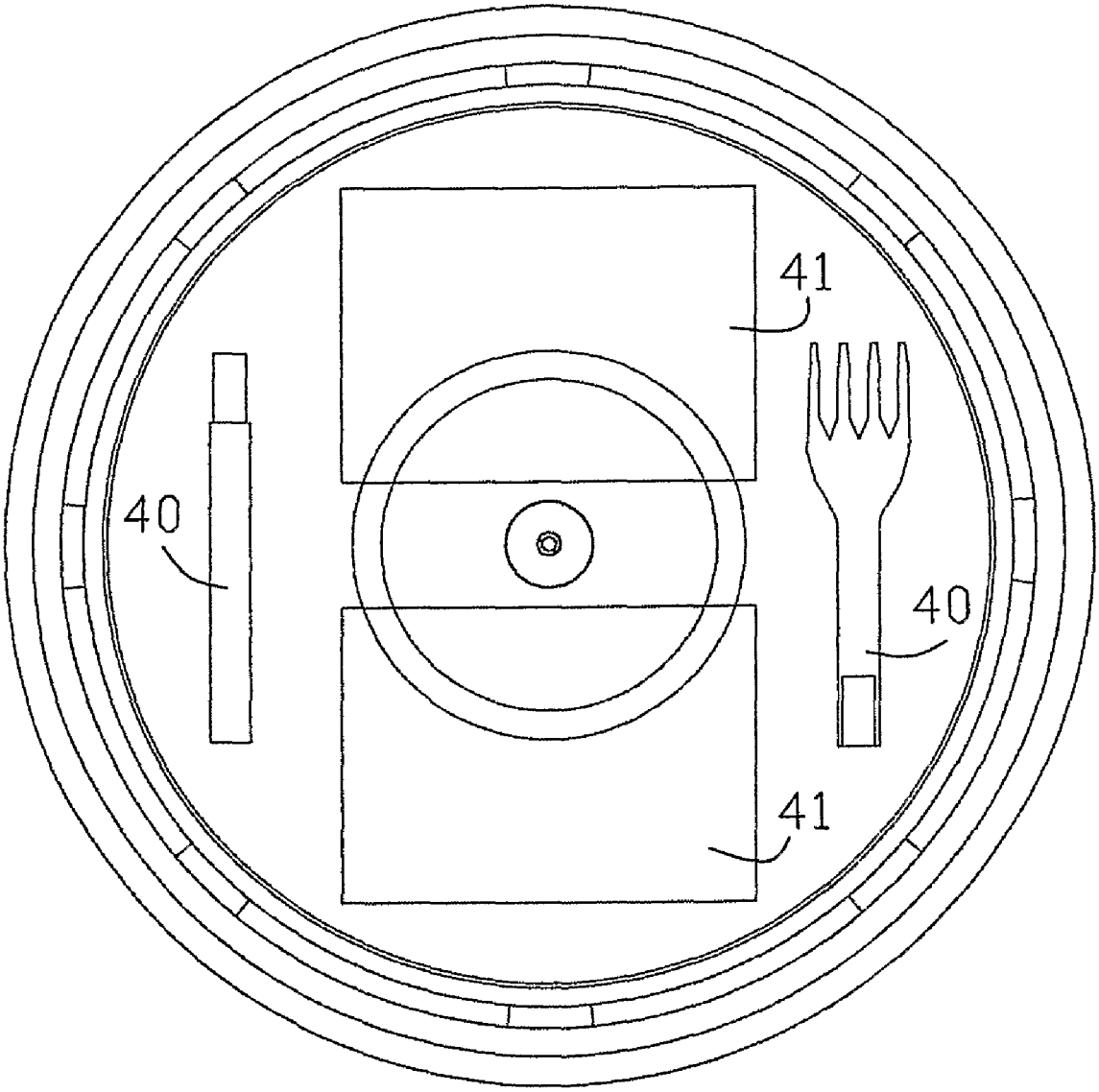
FIG. 10 the bottom view of the packaging with additionals (knives, forks, napkins and other components or integrators of the product)

Referring to FIG. 10, into the reentrant (10) between the base surface (8) and the inferior sealing film (22) the knives and forks (40), the napkin (41) and other components or additionals integrating the packaging can be inserted.

Figure 11:
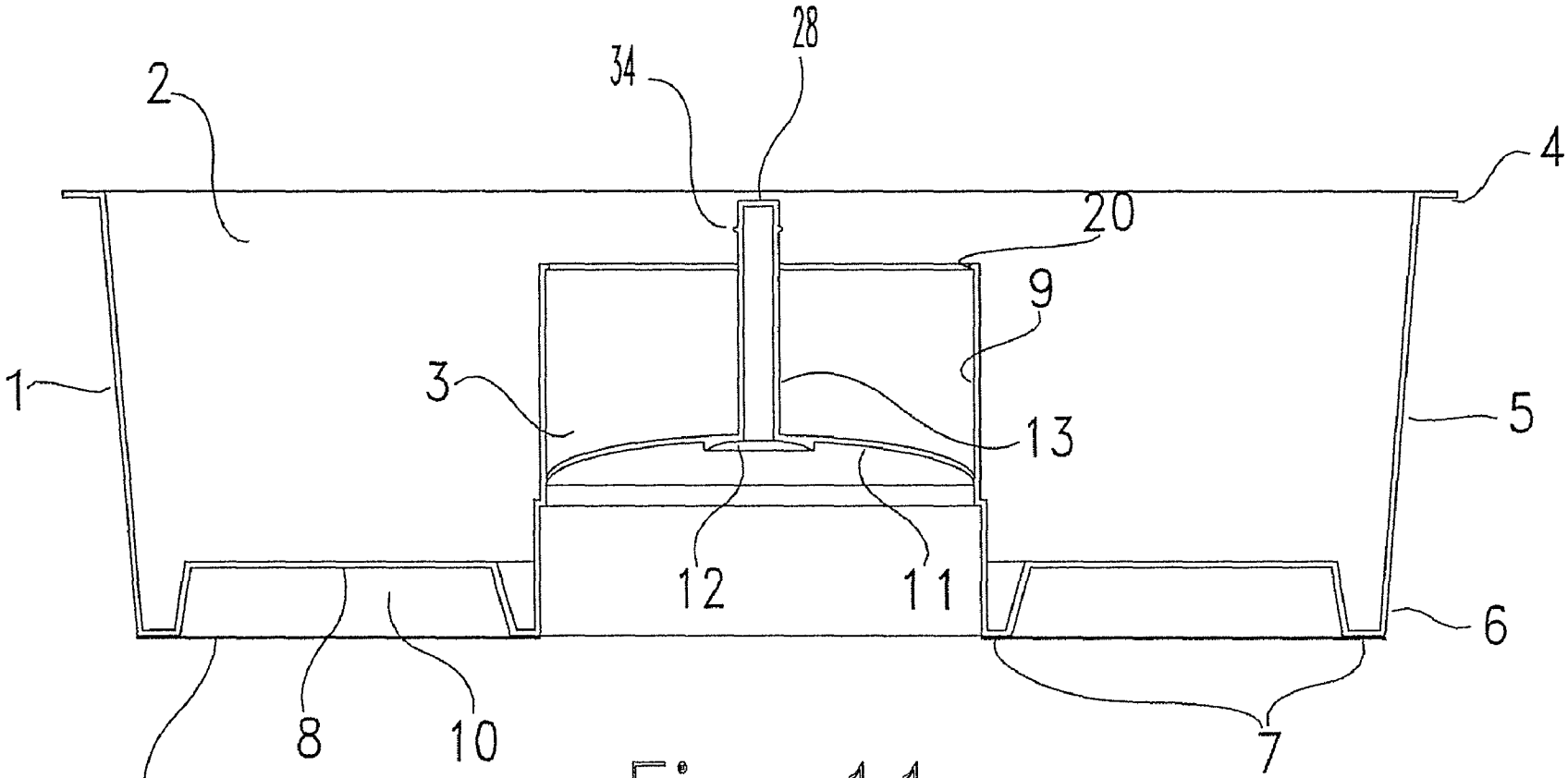
FIG. 11 vertical section of a variant of the container with the applied inferior sealing film.

Referring to FIG. 11, which shows a different mode of invention execution, the container (1), constituted by an external lateral wall (5), which ends with a superior flange (4), and by a base surface (8), forms a first compartment (2), internally limited by the wall (9) provided in the upper part with the perimetrical rib (20), with semicircular section in the figure.

To said wall (9) a mobile base (11) is jointed in order to form at least a second compartment (3).

Said mobile base (11) presents on its centre a vertical sliding guide (13), in this configuration internally provided with a septum (28), inside of which a hollow (12) is present which allows to realise an eventual manual pressure, while in the upper part a perimetrical nib (34) is present, with semicircular section in the figure.

Figure 12:
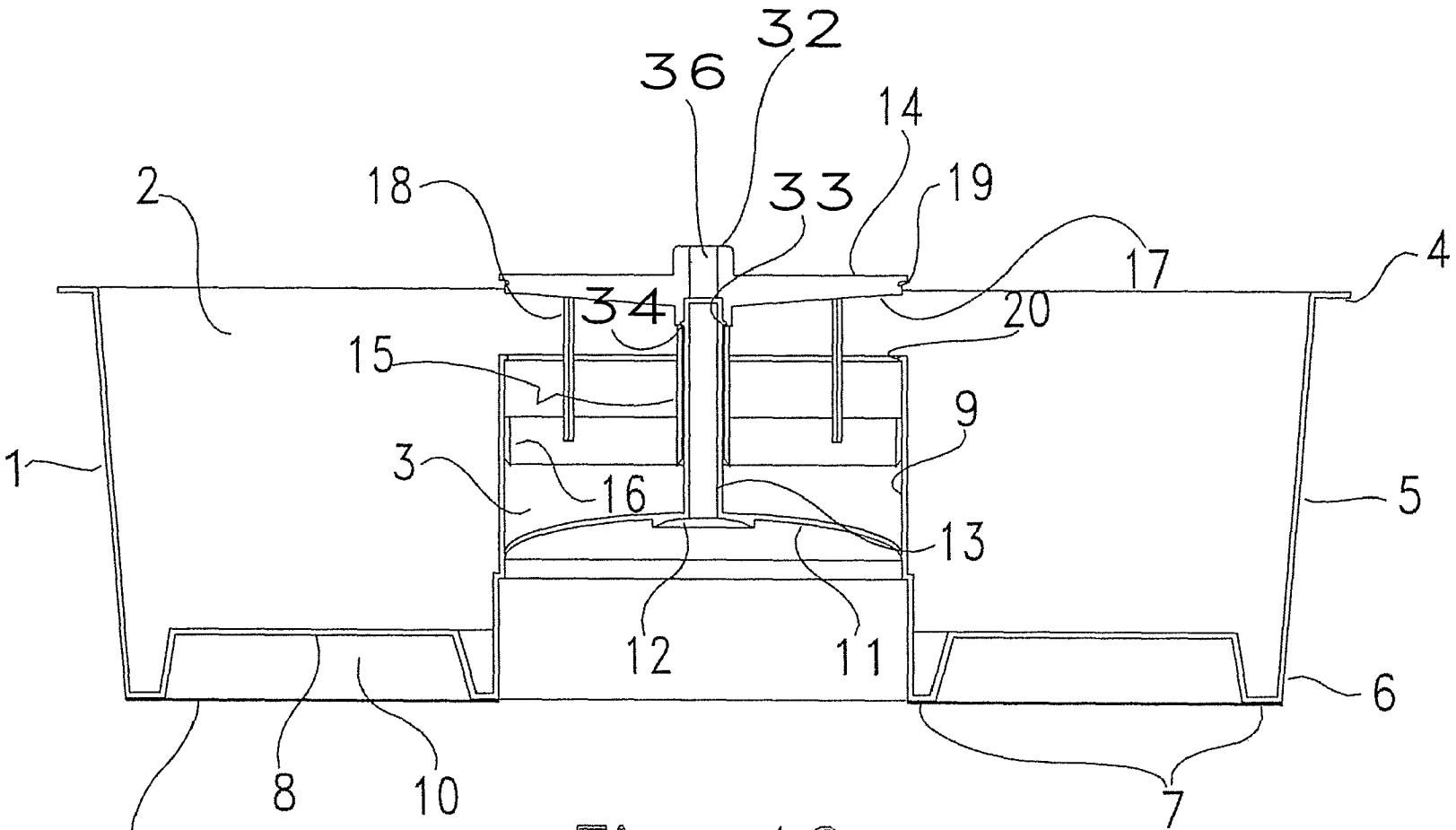
FIG. 12 vertical section of the container after the plug insertion, upon the filling of the second compartment 3.

The base surface (8) has two nibs (6) with two plain surfaces (7). Between the horns (6) and the base surface (8) a reentrant (10) is formed that inside can receive the additionals, not shown here, represented for example in FIG. 19, kept by means of an inferior sealing film (22), applied to the plain surfaces (7) by means of any known process. Referring to FIG. 12, in the second compartment (3), upon its filling with a specific component of the product, the plug (14) is introduced.

Said plug (14) is constituted by a sliding and coupling element (16) inside the wall (9), jointed, by means of linking bars (18), to the element (17) internally inclined in order to favour the runoff towards the first compartment (2) of the component placed inside the second compartment (3) and provided in the centre of the lower part with a coupling protuberance (15) which couples with the sliding guide (13).

The element (17) presents, besides, a perimetrical groove (19), with semicircular section in the figure which is complementary to the perimetrical rib (20), with semicircular section in the figure which the wall (9) ends with, and in the upper part it is provided in the centre with a hollowed structure which in this configuration defines the vent channel (36), which ends in the upper part with the surface (32) and in the lower part with a perimetrical groove (33), with a partial semicircular section in the figure, complementary to the rib (34) of the sliding guide (13), with semicircular section in the figure.

In the coupling protuberance (15) free spaces or openings (35), not visible here, which function will be explained further, are present.

Figure 13:
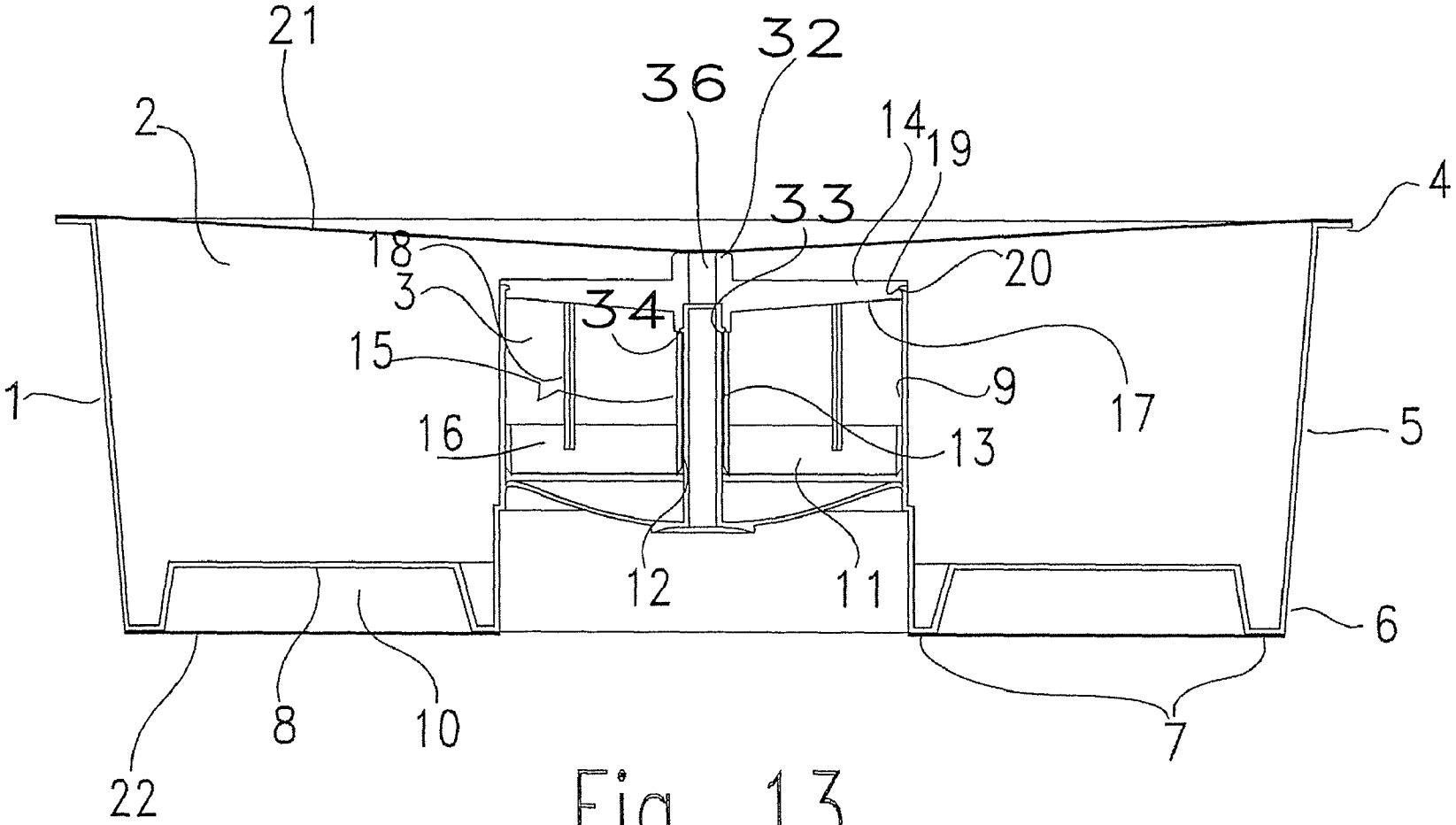
FIG. 13 vertical section of the container after the plug closure and the application of the superior sealing film, upon the filling of the first compartment 2.

Referring to FIG. 13, the plug (14), slides until closes the second compartment (3), adhering with the perimetrical groove (19) to the complementary perimetrical rib (20) of the wall (9) and, besides, with the perimetrical groove (33) to the complementary perimetrical rib (34) of the sliding guide (13).

During such operation the plug (14), by the strike effect between the coupled sliding guide (13) and coupling protuberance (15), moves down the mobile base (11), which deforms elastically in order to perform a function already described in FIG. 4 (further raising of the plug), and keeps it in this position since the closure with the plug (14) itself has been performed.

Realizing so, the separation between the compartments, the first compartment (2) can, hence, be filled in such a way that different components contact between each other only in the moment of usage of the product.

A superior sealing film (21) adheres to the superior flange (4) of the container (1) and to the surface (32), preferably by thermowelding or some known process, which permits anyway to maintain the perfect adherence of the superior sealing film (21) with both elements (4) and (32), also in the conditions of thermal variations during the heating or baking by means of the present invention. Besides, in this configuration the hole with a diameter equal to internal diameter of surface (32) necessary to allow the further communication of container (1) with the external environment through the vent channel (36) is practiced in correspondence to the surface (32).

In the usage phase, by effect of the pressure generated inside, the welding between the seal (52) and superior surface (32) of the plug (14) will be forced up to film breaking, freeing the communication passage of the channel (36) with the external environment of the container.

Figure 14:
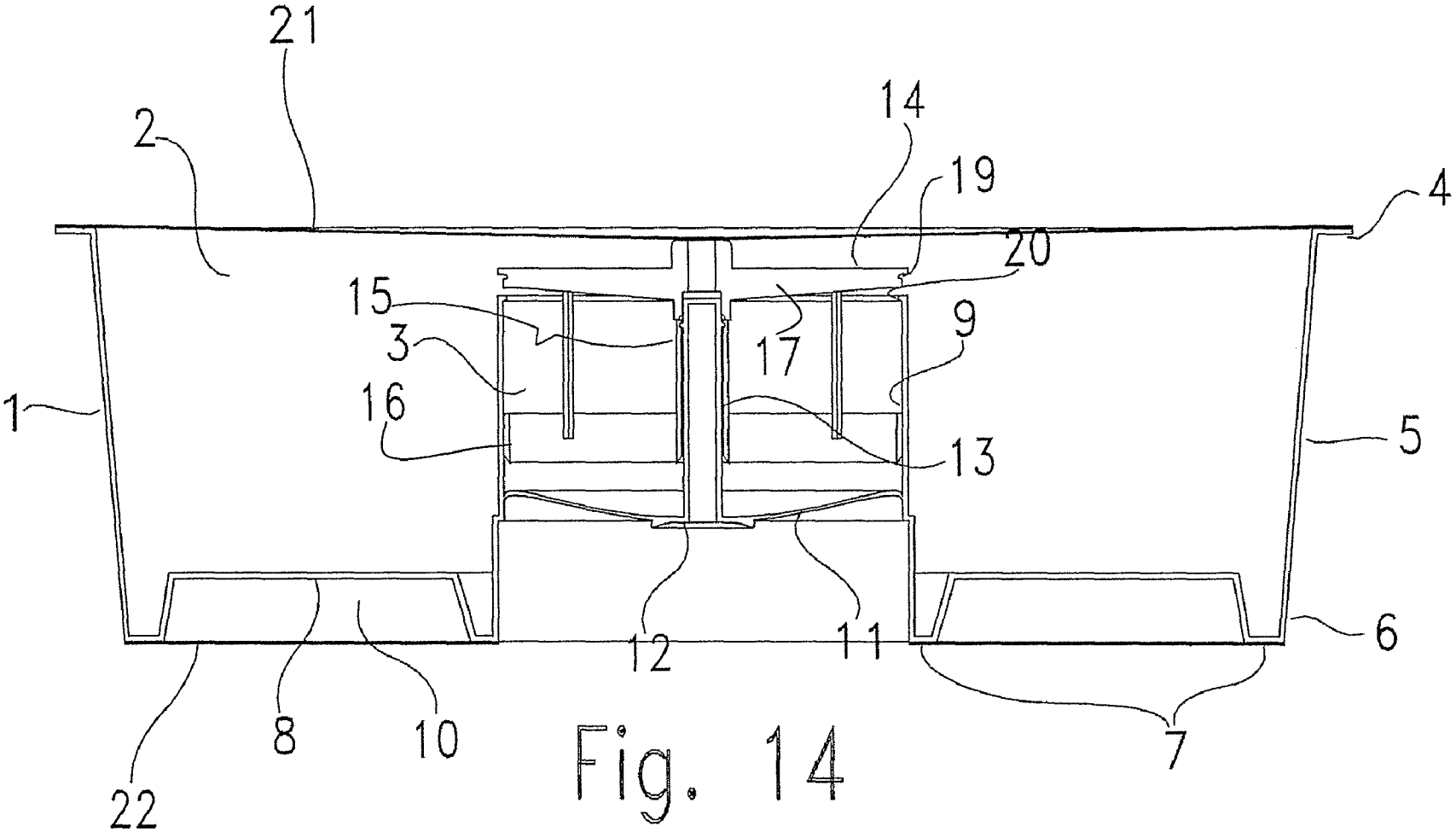
FIG. 14 vertical section of the variant of invention with container after the plug ejection from its closure position.

Referring to FIG. 14, the user, in base of the product requirements, either pushes onto the bottom, in correspondence of the hollow (12) of the mobile base (11), in order to execute by hand the plug (14) opening, eventually mixes also the two components of the product shaking the packaging and, finally, introduces it into an oven, for example microwave, or passes directly to this latter operation.

In the second case, when the preventive opening of the closure measures of the compartment (3) is not expected, a certain enhancing of the internal pressure of said compartment, which could occur, for example, during the baking or heating of the product makes the plug (14) spill out from its closure position.

The spill out of the plug (14) from its said closure position removes the barrier which keeps the elastically deformed mobile base, as indicated in FIG. 13. Consequently, said base returns to its original conformation, as shown in FIG. 12, pushing up the plug (14) to the stop position corresponding to the complete opening of the same, as it is better shown in the next FIG. 15.

Figure 15:
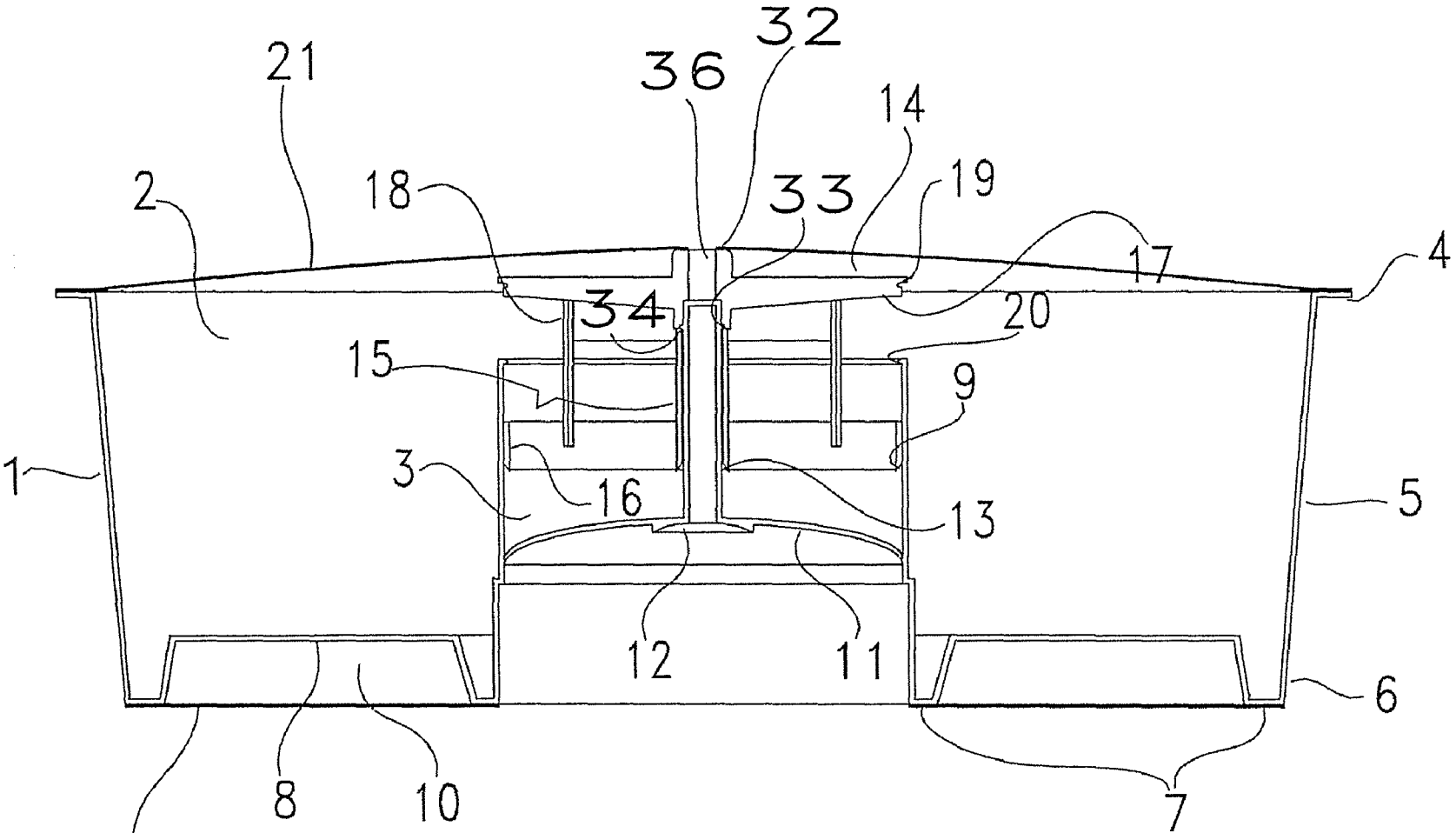
FIG. 15 vertical section of the variant of invention with container with the completely open plug.

Referring to FIG. 15, once the communication between different compartments is realized, the enhancement of the internal pressure of the container is compensated by reinflating of the superior sealing film (21).

Figure 16:
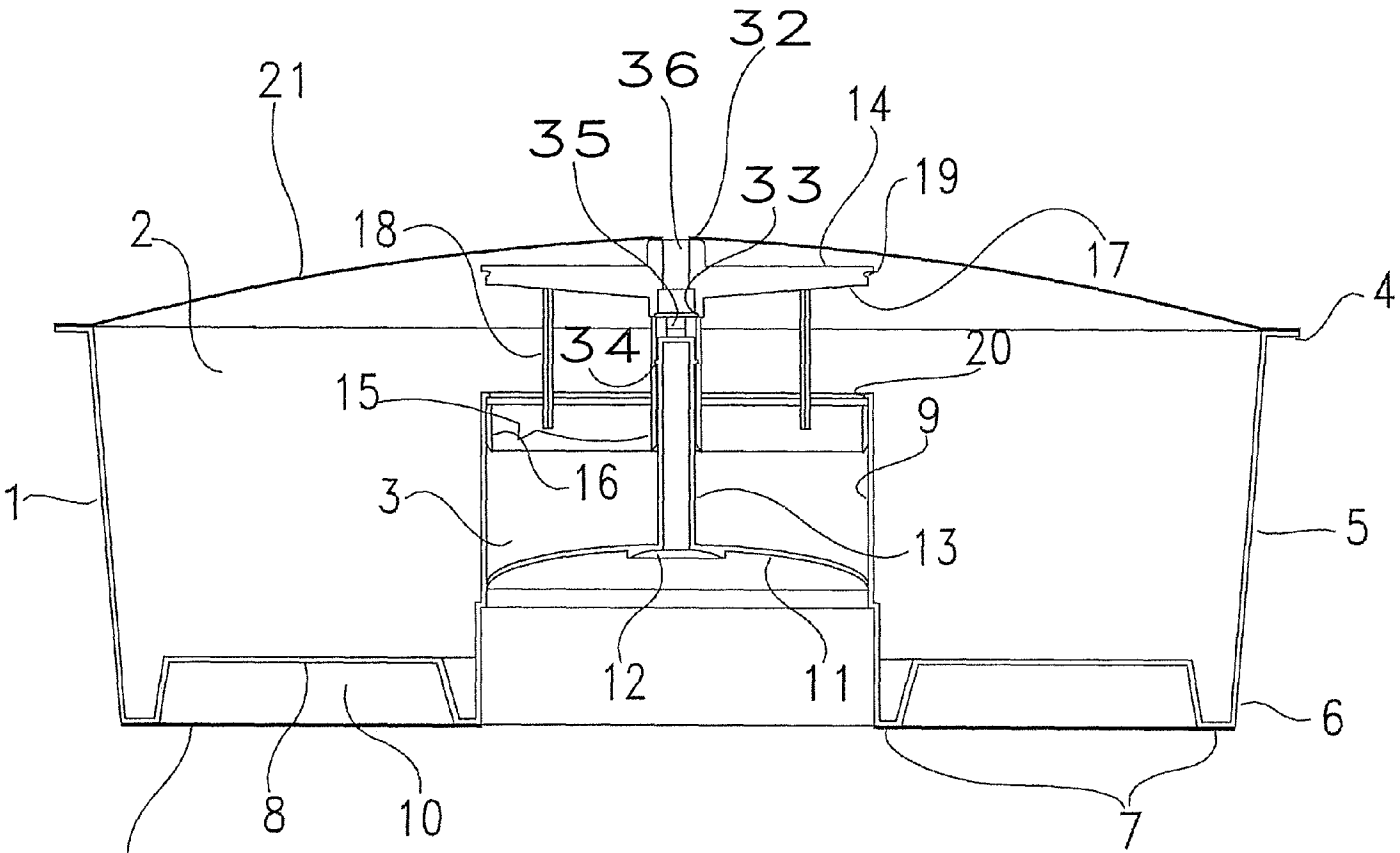
FIG. 16 vertical section of the variant of invention with container with activated vent devices.

Referring to FIG. 16, a further enhancement of internal pressure of the container (1) is compensated by a major reinflating of the superior sealing film (21). In consequence of the already described barrier between the superior sealing film (21) and the surface (32), said superior sealing film (21) pushes with itself the vent channel (36) in a vertical sliding movement, after having released the plug (14), where said vent channel (36), by means of element (17) is an integrated part, from the coupling between the groove (33) and the rib (34). Said vertical sliding movement goes on until the empty spaces or openings (35), present in the coupling protuberance (15), put into communication the container (1) with the external environment through said vent channel (36). In such a way it is possible both to control the internal pressure of the packaging, reducing it suitably in order to avoid any explosion danger, and to maintain optimal conditions for rapid and efficient heating or baking.

In an alternative realization mode illustrated in the FIGS. 21, 22 and 23, the plug (14) can, besides, be provided with a groove (50) drawed on the superior surface (32), in correspondence to the zone to be coupled with the film (21) by means of thermowelding or another known process. This groove (50) makes so that the coupling surface between the film (21) and the plug (14) is composed by two annular concentrical surfaces separated by the groove (50) itself. The utility of said groove (50) consists in the fact that it is possible to perform a precutting (51) (by a cutter or another known process) on the film in correspondence of the groove (50) itself, guaranteeing a keeping between the inside and outside of the packaging, in order to avoid the entry of foreign substances into the packaging itself. Hence, the described precutting realises a circular closure disc (52) (acting as a seal).

As shown in FIG. 16, the further enhancement of the internal pressure of the container is compensated by the reinflating of the superior sealing film (21). In consequence of the already described barrier between the superior sealing film (21) and the surface (32), said superior sealing film (21) pushes with itself the vent channel (36) in a vertical sliding movement, after having released the plug (14), where said vent channel (36), by means of element (17) is an integrated part, from the coupling between the groove (33) and the rib (34). The continuation of said vertical sliding movement determines the communication by means of empty spaces or openings (35) of the container (1) with the vent channel (36), which will be submitted to the internal pressure of the container.

The welding between the seal (52) and the inferior surface (32) of the plug (14), realized for achieving the following objective, is stressed by the pressure action until the film breaking and a consequent freeing of the communication passage between the channel (36) and the external environment of the container.

Referring to FIG. 7, (for example, following the temperature reduction after the temporary or definite suspension of heat or microwaves erogation from the heating or baking instrument), it is observed the reentering towards the internal part of the container (1), of the superior sealing film (21), which moves down the vent channel (36) up to closing the passage of the container (1) with the external environment realized by the openings (35).

Figure 17:
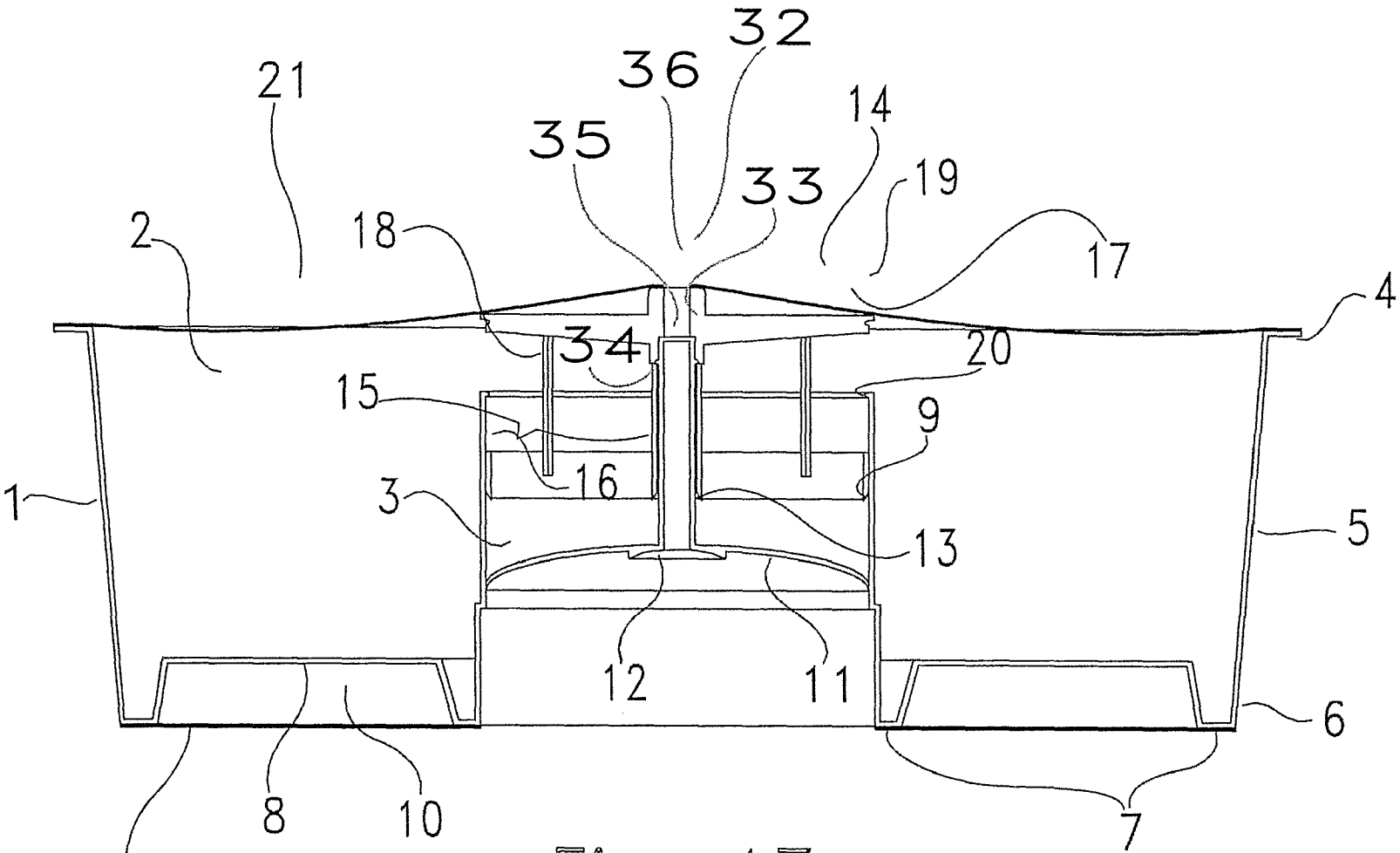
FIG. 17 vertical section of the variant of invention with container with closed vent devices.

Everything described in reference to the FIGS. 15-17 can repeat in a cycle up to the end of heating or baking.

Figure 18:
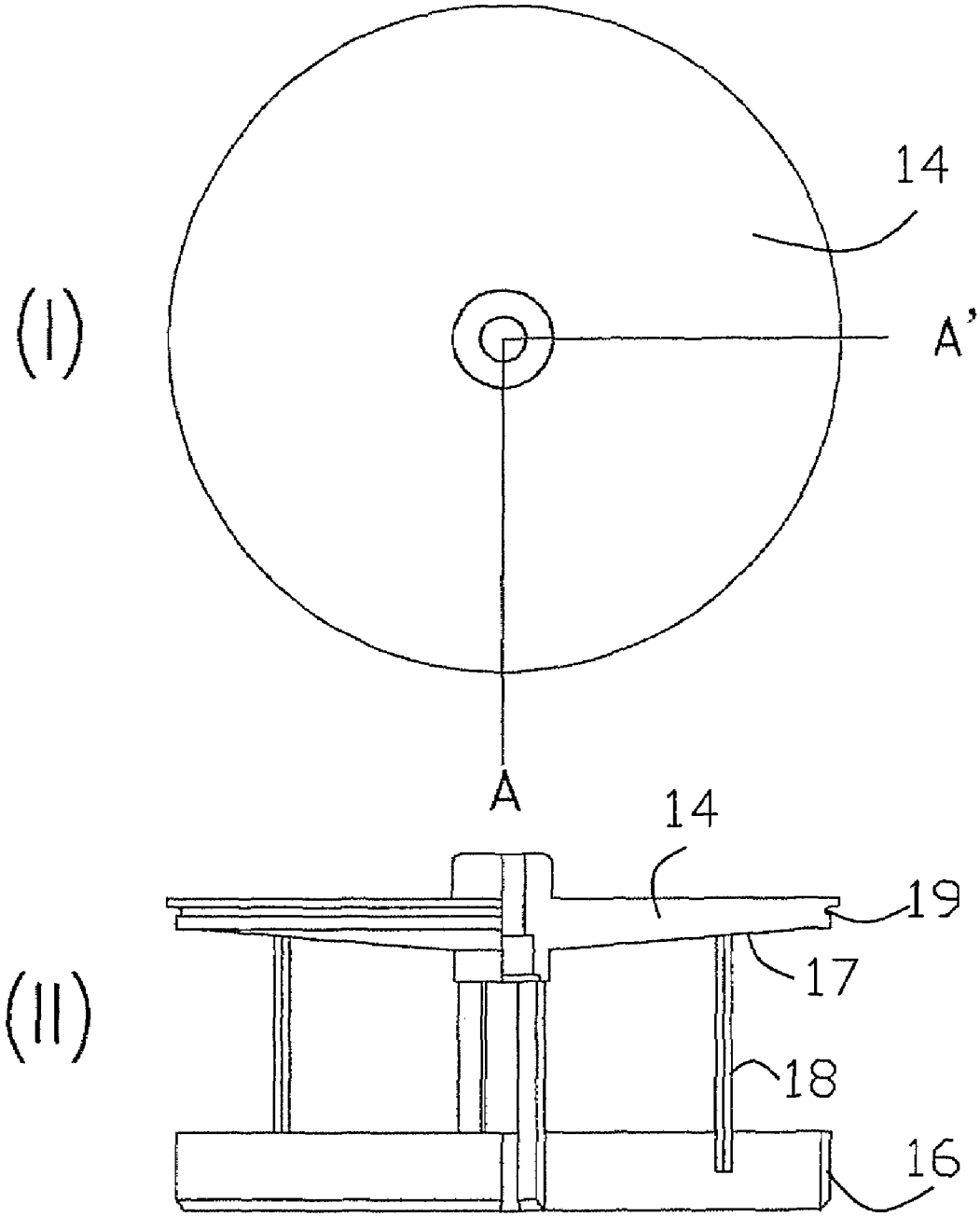
FIG. 18 (I) upper view of the plug.

Referring to FIG. 18, in the representation (I), the upper view of the plug (14) is shown, while in the representation (II) a longitudinal section A-A' and a partial prospect of said plug (14) are shown.

Figure 19:
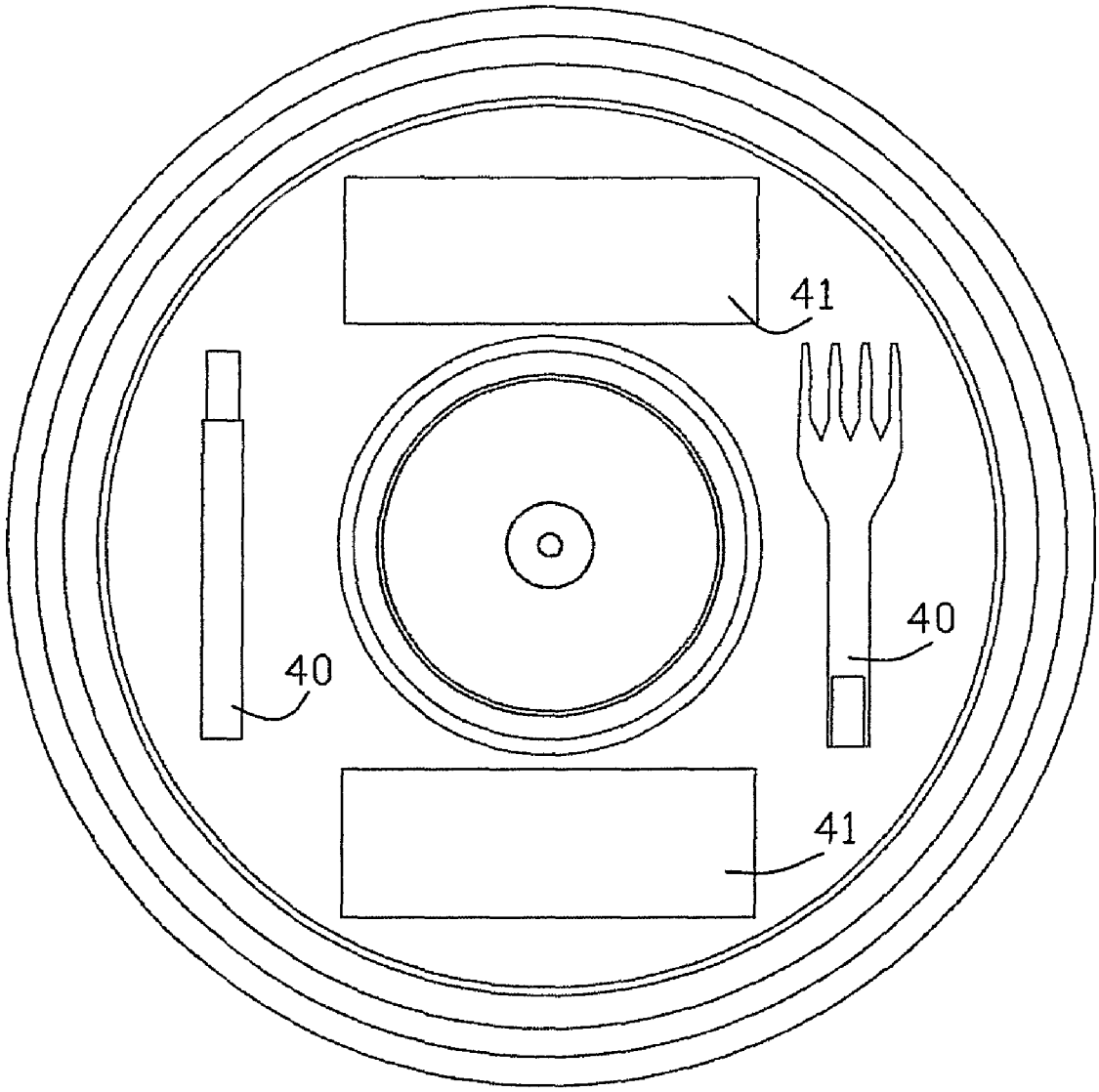
FIG. 19 the bottom view of the variant of packaging with additionals (knives, forks, napkins and other components or integrators of the product)

Referring to FIG. 19, into the reentrant (10) between the base surface (8) and the inferior sealing film (22) the knives and forks (40), the napkin (41) and other components or additionals integrating the packaging can be inserted.

Figure 20:
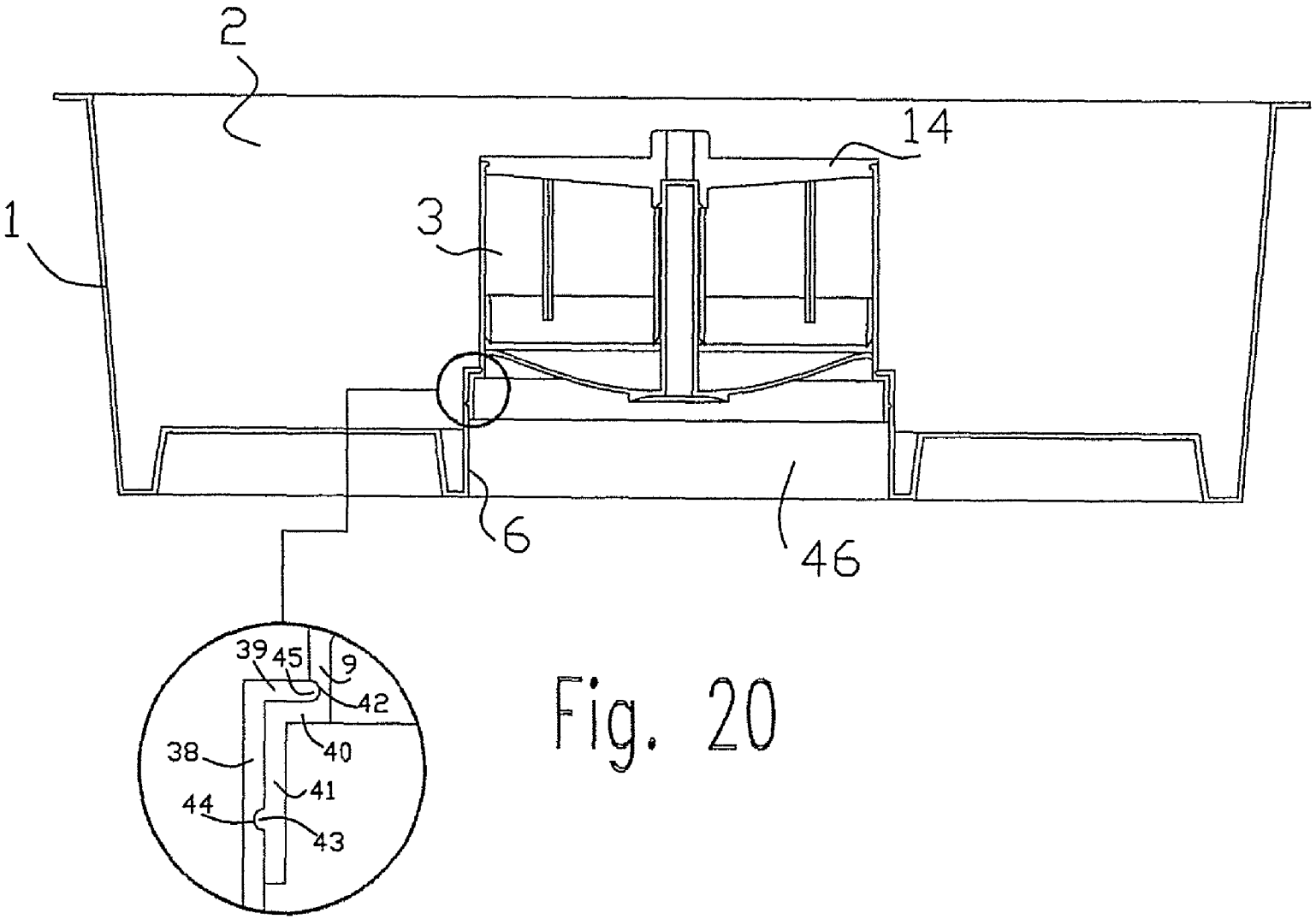
FIG. 20 vertical section of a variant in which the second compartment 3 is constituted by a piece separated from the first compartment 2.

Referring to FIG. 20, which represents a further variant of the invention, the second compartment (3) is constituted by a piece separated from the first compartment (2). Said second compartment (3), already partially filled and closed by plug (14), is inserted by spring means into the container (1), using the coupling hole (46), before the application of the sealing films (21) and (22), not shown here, offering, for example, the further advantage of being able to pack separately the second compartment (3) also in another industrial site or by thirds. The most internal nib (6) of the first compartment (2) has a wall (38) which presents a nib (39) with terminal board (45), with semicircular section in the figure. The second compartment (3) presents on the base of the wall (9) a nib (40) and a wall (41).

On the wall (9) and on the wall (38) two perimetrical grooves (42) and (44) are realised, with semicircular section in the figure, in which by spring means the bord (45) of the nib (39) as well as the rib (43), with semicircular section in the figure, present on the wall (41) and complementary to the mentioned grooves, key respectively, when the second compartment (3) reaches the final point determined by the strike between the complementary nibs (39) and (40).

An important functional characteristics of the present invention consists in the fact that the communication of the container (1) with the external environment, which is obtained through the openings (27, 35) of the vent channel (30, 36), is initially absent and can be disactivated or is disactivated automatically on the end of the utilization phase realized with said invention. It permits to mix at the beginning or in the end of the said phase the components contained in the compartments (2) and (3), without provoking the spill of the product out of the packaging, with obvious further remarkable advantages.

The invention, certainly, is not limited, to the representation of the figures, but can receive perfections and modifications from men skilled in the art, without going out of the patent frame.

The present invention permits numerous advantages and, particularly, allows to overcome the difficulties that could not be superated using the systems that are actually in commerce.

The invention claimed is:

1. A disposable packaging for maintaining separately components of a product up to the moment of usage and for venting vapors, said packaging comprising:

a container which defines a first compartment for a first component of a product, said container having an external lateral wall, a base surface, and a sealing film which closes said container; and at least one second compartment for a second component of said product to be put in contact with said first component, said second compartment having a wall, a base, and a plug which closes said second compartment, said second compartment having a vertical sliding guide, said plug having a coupling protuberance and said plug being slidable on said wall without uncoupling from said second compartment by means of a coupling and sliding element;

wherein said base of said second compartment is a mobile base between a tension position and a rest position, said tension position is achieved under an action from said plug achievable by a strike effect between said coupling protuberance and said sliding guide when said plug seals said second compartment, said rest position is achieved when said plug action ceases, which during a shifting of said base between said tension and rest positions said base acts on its turn against said plug provoking its opening and permitting communication between said first and second compartments;

wherein said plug further comprising a vapor vent channel defined therein and at least one defined opening in communication with said vent channel and said container, said vent channel is joined to said sealing film by a surface;

wherein said sealing film, through pressure effect, is moveable reinflating outside or reentering inside said container, and during such movement said sealing film drags said vent channel so that said opening of said plug places in communication said container with an external environment outside of said container.

2. The disposable packaging as set forth in claim 1, wherein said plug is provided with a groove on said surface of said plug in correspondence of an area to be joined with said film so that a joined surface between said film and said plug is composed by two concentrical surfaces separated by said groove, that in correspondence of said groove a precutting is performed which guarantees keeping between inside and outside of said packaging, in order to avoid entry of foreign substances into said packaging or avoid a spill of material out of the inside of said packaging, and wherein said groove realizes a circular closure disc adapted to be pushed up by the pressure effect thereby opening said vent channel and keeping in contact said container with the external environment through said openings.

3. The disposable packaging as set forth in claim 1, wherein said vertical sliding guide of said second compartment presents internally a septum.

4. The disposable packaging as set forth in claim 1, wherein said vertical sliding guide of said second compartment is grooved.

5. The disposable packaging as set forth in claim 4, wherein said vent channel and said opening are defined in a stem valve which is inserted in said plug and in said vertical sliding guide.

6. The disposable packaging as set forth in claim 5, wherein said plug has on its superior part a perimetrical groove which corresponds to a perimetrical rib on the superior part of said stem valve.

7. The disposable packaging as set forth in claim 1, wherein said opening used for communication between said container and the external environment is defined in said coupling protuberance.

8. The disposable packaging as set forth in claim 1, wherein said vertical sliding guide has a perimetrical rib corresponding to a perimetrical groove present in said coupling protuberance of said plug.

9. The disposable packaging as set forth in claim 8, wherein said second compartment is constituted by a piece separated from said first compartment, and said second compartment, already filled and closed by said plug, is inserted by a snap-fit means into said container using a coupling hole before an application of said sealing film.

10. The disposable packaging as set forth in claim 9, where said base surface of said container has at least one nib with at least one plain surface.

11. The disposable packaging as set forth in claim 10, wherein an internal portion of said nib of said base surface of said container has a wall which presents a nib, and said second compartment presents on a base of said wall a nib and a wall on which a nib is placed, and wherein on said wall of said second compartment and on said wall of said base surface of said container has two grooves in which a terminal board of said nib of said base surface and said nib of said wall of said wall base of said second compartment correspond to said two grooves key into said snap-fit means.

12. The disposable packaging as set forth in claim 11, wherein said base of said second compartment in correspondence to said vertical sliding guide has, on its inferior face, a hollow which permits the use of manual pressure to open said plug of said second compartment.

13. The disposable packaging as set forth in claim 1, wherein a free end of said wall of said second compartment has a perimetrical rib, and said plug has a perimetrical groove corresponding to said perimetrical rib of said wall of said second compartment for hermetically sealing said plug and said wall of said second compartment.

14. The disposable packaging as set forth in claim 1, wherein said coupling and sliding element is linked by means of linking bars to an element of said plug.

15. The disposable packaging as set forth in claim 14, wherein said element has an inclined internal face.

16. The disposable packaging as set forth in claim 1, wherein said container has a reentrant between said base surface and at least one nib, said reentrant being closeable by a cover, said reentrant being adapted to receive objects selected from the group consisting of knives, forks, spoons, utensils, and napkins.

17. The disposable packaging as set forth in claim 1, wherein said sealing film is adhered to a flange of said container.

18. A disposable packaging for maintaining separately components of a product up to the moment of usage and for venting vapors, said packaging comprising:

a container for a first component of a product, said container having an external lateral wall which ends with a superior flange, and a base surface, said container defining a first compartment internally limited by a wall superiorly provided with a perimetrical rib;

a sealing film adapted to cover said container, said sealing film being joined to said superior flange of said container;

a second compartment for a second component of said product to be put in contact with said first component, said second compartment being defined internally of said wall of said container, and a mobile base, said mobile base has a vertical sliding guide centrally located on said mobile base; and a plug adapted to close said second compartment, said plug having a coupling protuberance, and a stem valve insertable into said plug, said plug being slidable on said wall shared by said first and second compartments without uncoupling from said second compartment by means of a coupling and sliding element, said stem valve defining a vent channel therein and a plurality of openings in communication with said vent channel and said container, said vent channel being joined to said sealing film of said container by a surface;

wherein said mobile base of said second compartment is moveable between a tension position and a rest position, said tension position is achieved under an action from said plug which is achieved by a strike effect between said coupling protuberance and said sliding guide when said plug seals said second compartment, said rest position is achieved when said plug action ceases, which during a shifting of said mobile base between said tension and rest positions said mobile base acts on its turn against said plug provoking its opening and permitting communication between said first and second compartments;

wherein said sealing film, through pressure effect, is moveable reinflating outside or reentering inside said container, and during such movement said sealing film pushes said vent channel so that said openings of said stem valve places in communication said container with an external environment outside of said container.

19. The disposable packaging as set forth in claim 18, wherein said plug is provided with a groove on said surface of said vent stem valve of said plug in correspondence of the area to be joined with said sealing film so that the joined surface between said sealing film and said plug is composed by two concentrical surfaces separated by said groove, that in correspondence of said groove a precutting is performed which guarantees sealing between inside and outside of said packaging in order to avoid the entry of foreign substances into said packaging or avoid a spill of material out of the inside of said packaging, and wherein said groove comprises a circular closure disc adapted to be pushed up by the pressure effect thereby opening said vent channel and keeping in contact said container with the external environment through said openings.

20. A disposable packaging for maintaining separately components of a product up to the moment of usage and for venting vapors, said packaging comprising:

a container for a first component of a product, said container having an external lateral wall which ends with a superior flange, and a base surface, said container defining a first compartment internally limited by a wall superiorly provided with a perimetrical rib;

a sealing film adapted to cover said container, said sealing film being joined to said superior flange of said container;

a second compartment (3) for a second component of said product to be put in contact with said first component, said second compartment being defined internally of said wall of said container, and a mobile base, said mobile base has a vertical sliding guide centrally located on said mobile base; and a plug adapted to close said second compartment, said plug having a coupling protuberance, and a stem valve insertable into said plug, said plug being slidable on said wall shared by said first and second compartments without uncoupling from said second compartment by means of a coupling and sliding element, said stem valve defining a vent channel therein and a plurality of openings in communication with said vent channel and said container, said vent channel being joined to said sealing film of said container by a surface, said surface having a groove in an area to be joined with said sealing film so that a joined surface between said sealing film and said vent channel is composed by two concentrical surfaces separated by said groove;

wherein said mobile base of said second compartment is moveable between a tension position and a rest position, said tension position is achieved under an action from said plug which is achieved by a strike effect between said coupling protuberance and said sliding guide when said plug seals said second compartment, said rest position is achieved when said plug action ceases, which during a shifting of said mobile base between said tension and rest positions said mobile base acts on its turn against said plug provoking its opening and permitting communication between said first and second compartments;

wherein said sealing film, through pressure effect, is moveable reinflating outside or reentering inside said container, and during such movement said sealing film pushes said vent channel so that said openings of said stem valve places in communication said container with an external environment outside of said container;

wherein said groove being adapted to perform a precutting on said sealing film guaranteeing a keeping between inside and outside of said packaging in order to avoid entry of foreign substances into said packaging or avoid a spill of material out of the inside of said packaging, and wherein said groove comprises a circular closure disc adapted to be pushed up by the pressure effect thereby opening said vent channel and keeping in contact said container with the external environment through said openings.

* * * * *